US009564001B2

(12) United States Patent
Owen et al.

(10) Patent No.: US 9,564,001 B2
(45) Date of Patent: Feb. 7, 2017

(54) PLAYER SELECTION GAME WITH ACCUMULATED SYMBOL DISPLAY

(71) Applicant: EVERI GAMES INC., Austin, TX (US)

(72) Inventors: Clint Owen, Austin, TX (US); Eric Harrelson, Austin, TX (US)

(73) Assignee: Everi Games Inc., Austin, TX (US)

( * ) Notice: Subject to any disclaimer, the term of this patent is extended or adjusted under 35 U.S.C. 154(b) by 0 days.

(21) Appl. No.: 14/287,144

(22) Filed: May 26, 2014

(65) Prior Publication Data

US 2014/0256405 A1 Sep. 11, 2014

Related U.S. Application Data

(63) Continuation of application No. 13/249,650, filed on Sep. 30, 2011, now Pat. No. 8,734,222, which is a continuation-in-part of application No. 13/197,015, filed on Aug. 3, 2011, now Pat. No. 8,602,867.

(51) Int. Cl.
*G07F 17/34* (2006.01)
*G07F 17/32* (2006.01)

(52) U.S. Cl.
CPC ..... *G07F 17/3211* (2013.01); *G07F 17/3244* (2013.01); *G07F 17/34* (2013.01)

(58) Field of Classification Search
CPC ..... G07F 17/32; G07F 17/3211
USPC ..... 463/20
See application file for complete search history.

(56) References Cited

U.S. PATENT DOCUMENTS

| | | | | |
|---|---|---|---|---|
| 6,089,977 | A | 7/2000 | Bennett | |
| 6,309,300 | B1 | 10/2001 | Glavich | |
| 6,346,043 | B1 * | 2/2002 | Colin et al. | 463/17 |
| 6,347,996 | B1 * | 2/2002 | Gilmore et al. | 463/17 |
| 6,439,993 | B1 | 8/2002 | O'Halloran | |
| 6,454,266 | B1 | 9/2002 | Breeding et al. | |
| 6,561,900 | B1 | 5/2003 | Baerlocher et al. | |
| 6,616,531 | B1 | 9/2003 | Mullins | |
| 6,866,583 | B2 | 3/2005 | Glavich et al. | |
| 6,878,061 | B2 | 4/2005 | Baerlocher et al. | |
| 7,553,231 | B2 | 6/2009 | Rodgers et al. | |
| 7,666,083 | B2 | 2/2010 | Baerlocher et al. | |
| 7,689,302 | B2 | 3/2010 | Schlottmann et al. | |
| 7,717,786 | B1 | 5/2010 | Falciglia, Sr. | |
| 7,749,071 | B2 | 7/2010 | Marks et al. | |
| 7,901,283 | B2 | 3/2011 | Thomas et al. | |
| 2005/0282615 | A1 | 12/2005 | Englman et al. | |
| 2011/0118003 | A1 * | 5/2011 | Nakamura | 463/20 |

* cited by examiner

*Primary Examiner* — Omkar Deodhar
*Assistant Examiner* — Shauna-Kay Hall
(74) *Attorney, Agent, or Firm* — Nathan Calvert, Esq.; Russell D. Culbertson, Esq.; JP Cody, Esq.

(57) ABSTRACT

A player selection game feature includes picking hidden selections to accumulate matching symbols and win a prize. Symbol accumulation areas are displayed along with the symbol location field from which player selections are made. These symbol accumulation areas help the player track the game symbols which have been selected. As a prize bump bonus symbols may be included in the player selection game to increase the value of all available prizes in the game.

17 Claims, 25 Drawing Sheets

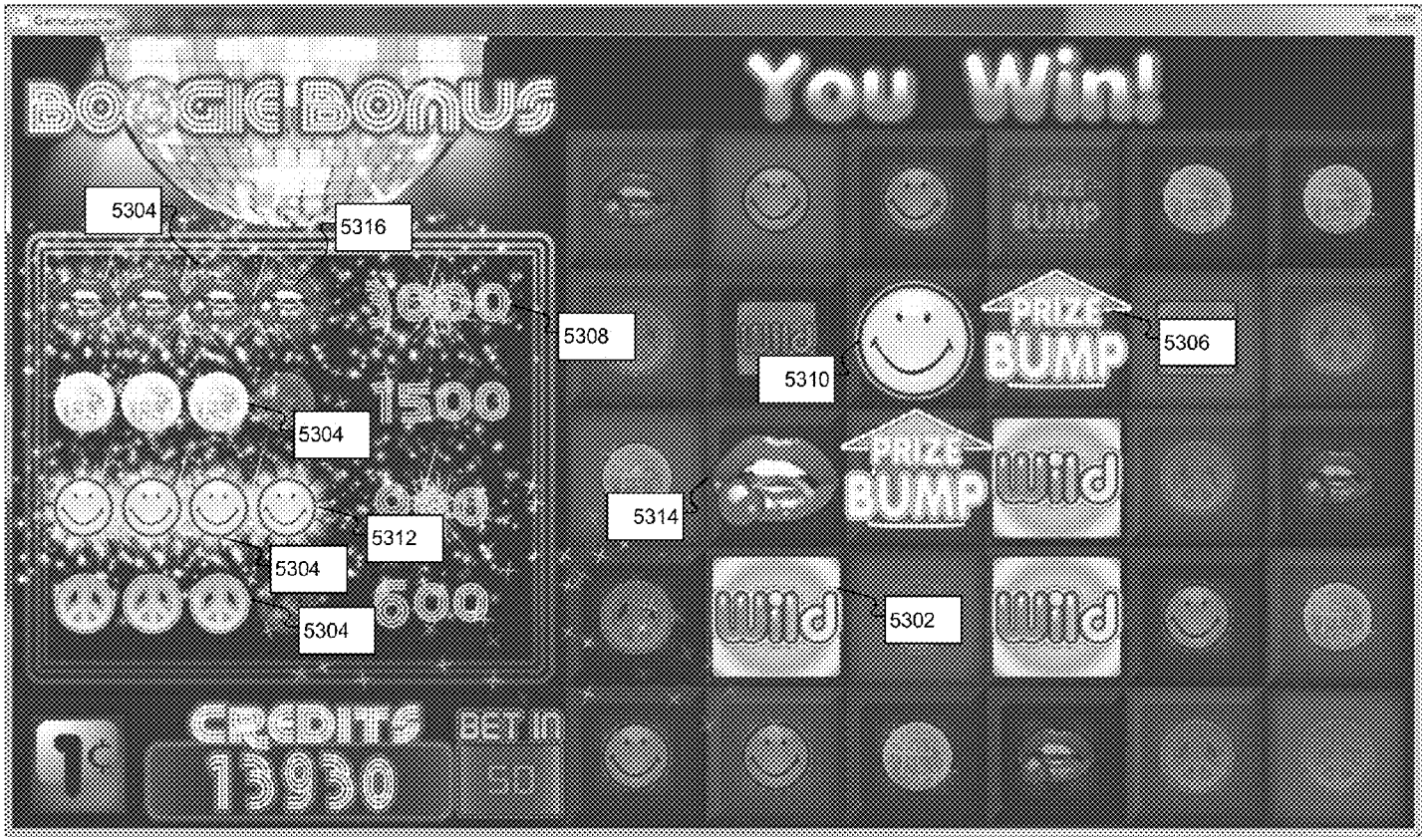
5300
5302
5304
5304
5304
5304
5306
5308
5310
5312
5314
5316
You Win!
PRIZE BUMP
PRIZE BUMP
Bonus
Bonus
Bonus

PLAYER SELECTION GAME WITH ACCUMULATED SYMBOL DISPLAY

CROSS-REFERENCE TO RELATED APPLICATIONS

This application is a continuation of U.S. patent application Ser. No. 13/249,650 filed Sep. 30, 2011 and entitled "Slot Machine Game With Alternating Wild Symbol," which is a continuation-in-part of U.S. patent application Ser. No. 13/197,015 filed Aug. 3, 2011 and entitled "Slot Machine Game With Alternating Wild Symbol." Applicants claim the benefit of each of these prior applications under 35 U.S.C. §120. The entire content of each of the above-identified U.S. patent applications is incorporated herein by this reference.

COPYRIGHT NOTICE

A portion of the disclosure of this patent document contains material which is subject to copyright protection. The copyright owner has no objection to the facsimile reproduction of the patent document or the patent disclosure, as it appears in the U.S. Patent and Trademark Office patent files or records, but otherwise reserves all rights.

TECHNICAL FIELD OF THE INVENTION

The invention relates to gaming systems and gaming machines through which players may participate in wagering games. More particularly this invention relates to methods for conducting a player selection game with enhanced features.

BACKGROUND OF THE INVENTION

Various wagering games use a player selection feature as either part of a primary game or part of a bonus or secondary game to increase player participation and interest in the game. Gaming machine providers and casino operators continue to search for new gaming machines which capture a player's interest and provide enhanced entertainment value.

SUMMARY OF THE INVENTION

The present invention encompasses methods for providing a player selection game to increase player excitement and thus provide better entertainment value. A method according to various embodiments of the invention includes displaying a number of symbol locations in an initial state in a symbol location field of a gaming machine display system. Each symbol location in this initial state provides an area in which to display a respective game symbol, but at this point in the game shows a graphic other than the respective game symbol. The method further includes receiving a player selection input through a player input system associated with the gaming machine. The player selection input indicates a respective one of the symbol locations in the initial state. In response to the player selection input, the method includes displaying a respective game symbol at the indicated one of the symbol locations so that the indicated symbol location (that is, the player selected symbol location) is no longer in the initial state. The respective game symbol displayed at the indicated symbol location is a symbol from a set of game symbols defined for the game. In addition to displaying the symbol location field, the method according to various embodiments of the invention includes displaying two or more symbol accumulation areas on the gaming machine display system. Each respective symbol accumulation area is defined for a respective winning symbol comprising one of the game symbols and is displayed in an area of the display system separate from the symbol location field. When the game symbol displayed at a respective symbol location responsive to a player selection is one of the winning symbols, that winning symbol is displayed in the symbol accumulation area defined for that winning symbol. This display of winning symbols as they are selected tracks the progress of the player selections toward a win. The player selections and responsive steps are repeating until reaching a game ending condition such as a specified number of player selections or achieving a win, or any other suitable game ending condition. Upon reaching the game ending condition, the method includes awarding any prize defined for the number of winning symbols displayed in the symbol accumulation area defined for that winning symbol.

In some embodiments of the invention, a prize is displayed for each symbol accumulation area. The displayed prize is the prize to be awarded for reaching a predefined number of the winning symbols for the given symbol accumulation area.

The game symbols defined for the player selection game may include prize bump symbols and wild symbols. Where a prize bump symbol is displayed in response to a player selection, one or more of the prizes displayed for the symbol accumulation areas may be increased in some fashion. When a wild symbol is displayed in response to a player selection, that wild symbol may count toward one or more winning symbols defined for the game, and thus may assist the player in reaching the predefined number of winning game symbols for a given instance of the player selection game.

Embodiments of the invention may be implemented through a computer program stored in suitable non-transitory computer readable medium. The program code may be executed by a processor associated with a gaming machine or networked gaming system. The present invention encompasses methods of operating a gaming machine, program products storing program code executable to implement the methods, and gaming machines which execute the program code to implement the methods.

These and other advantages and features of the invention will be apparent from the following description of illustrative embodiments, considered along with the accompanying drawings.

BRIEF DESCRIPTION OF THE DRAWINGS

FIG. 5D is a game screen diagram showing an example conclusion of the player selection game according to one embodiment.

DESCRIPTION OF ILLUSTRATIVE EMBODIMENTS

In the following description, FIGS. 1A through 2D will be used to describe various embodiments of a wagering game which may be used as a base game for a player selection game according to the present invention. Embodiments of the player selection game will be described in connection with an example implementation illustrated in FIGS. 5A through 5D. FIGS. 3A through 4B illustrate example gaming machines and gaming networks which may be used to implement both the base game and the player selection game.

Although the player selection game implementation illustrated in the figures is shown as a bonus game which is entered from a base game, implementations of a player selection game according to the present invention are not limited to bonus games. Rather, a player selection game within the scope of the claims may be a primary game, a secondary or bonus game, or a game at any other level, or may be a standalone game which is not associated with any other game or feature.

Figure 1A:
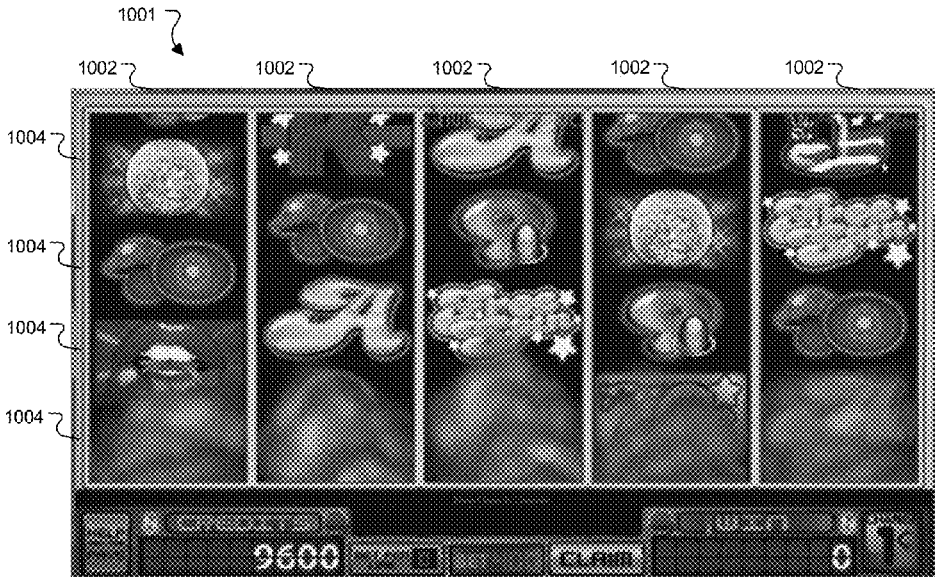
FIGS. 1A-1H, 1J-1N, and 1P-1S are a series of sequential game screen diagrams from an example game using an alternating wild symbol feature in a game which may be used as a based game for a player selection game according an embodiment of the present invention.

FIGS. 1A-1H, 1J-1N, and 1P-1S are a series of sequential game screen diagrams from an example game using an alternating wild symbol feature according to one embodiment. FIG. 1A is a game screen diagram for an in progress game that has started an alternating wild feature according to one embodiment. In this embodiment, the graphics display includes a matrix of symbol locations 1001 that displays symbols in four locations 1004 on each of five separate reels 1002. In the example game screen, a game result shown is beginning to display an alternating wild sequence. This version provides an alternating wild sequence at the beginning of play of the base game round. While the reels are spinning, alternating wild symbols may be shown to traverse or flip across the screen to designate certain positions as having wild symbol functionality. In a preferred version, this transformation is accompanied by animation of an alternating wild symbol flipping along the designated path. As it moves, the alternating wild symbol alternates or flips from a "flip" side to a "wild" side. In every reel position that a "wild" lands, a wild is left in place.

In some versions, the reels are shown to spin while the alternating wild symbols traverse the screen. In this particular example, the feature is highlighted by obscuring the graphics of the spinning reels 1002 with a graphic of a smokescreen, as may be seen depicted in the drawing along the bottom row of symbol locations 1004. In this version, in a base game round that includes an alternating wild sequence, the smokescreen is animated to fill the array 1001 while the reels are spinning, as is shown in process in FIG. 1B. Such a feature may be useful in embodiments employing reverse-mapped game logic, in which an outcome is randomly selected and then a game presentation is shown to match the outcome. For example, one preferred embodiment uses a Class II bingo game engine to produce outcomes (such as that produced by the assignee of the present invention at the time of filing this application, Multimedia Games Inc.), and then selects a scripted game presentation to present the outcome. The smokescreen feature depicted in FIG. 1A, or a similar feature that obscures or interrupts the depicted reel spin on the gaming machine, may be employed to present such a reverse-mapped game to enable the game presentation to animated reels spinning immediately when the play button is pushed, but then change the animated outcome to the selected reel spin and reel stop for the current game outcome when the animation leaves the smokescreen presentation. This is useful for presenting bingo game results which may only be made available by a gaming outcome server after a delay of several seconds following the play button push.

Figure 1B:
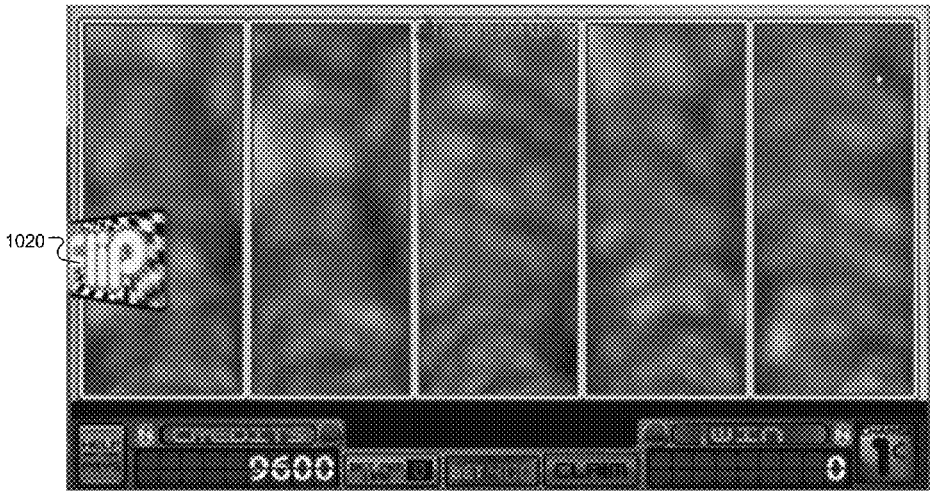

FIG. 1B is a subsequent game screen diagram for the same game showing an alternating wild symbol 1020 flipping onto the screen from the left side as shown in the drawing, with the flip (not wild) side appearing. In this sequence, because the flip side of the symbol 1020 appears in the first column in the depicted array, a wild symbol is not deposited in the first, and the symbol 1020 continues to flip or alternate as it travels along a path determined by the game controller.

Figure 1C:
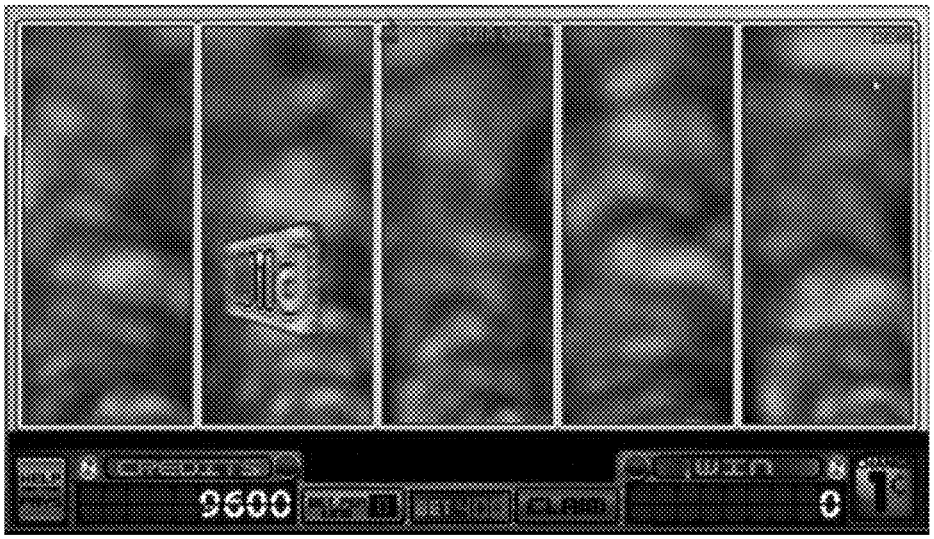

FIG. 1C is a game screen diagram after that of FIG. 1B, showing the same alternating wild symbol flipping over to display its wild side at the next location of the path determined for this symbol, which happens to be continued movement to the right in this example path. Because the symbol 1020 is flipped over to its wild side in the symbol location where it lands in the second column of symbol locations (as shown by the graphics adorning the flipping symbol in the drawing) the symbol deposits the wild status by depositing some designation or symbol at that symbol location.

Figure 1D:
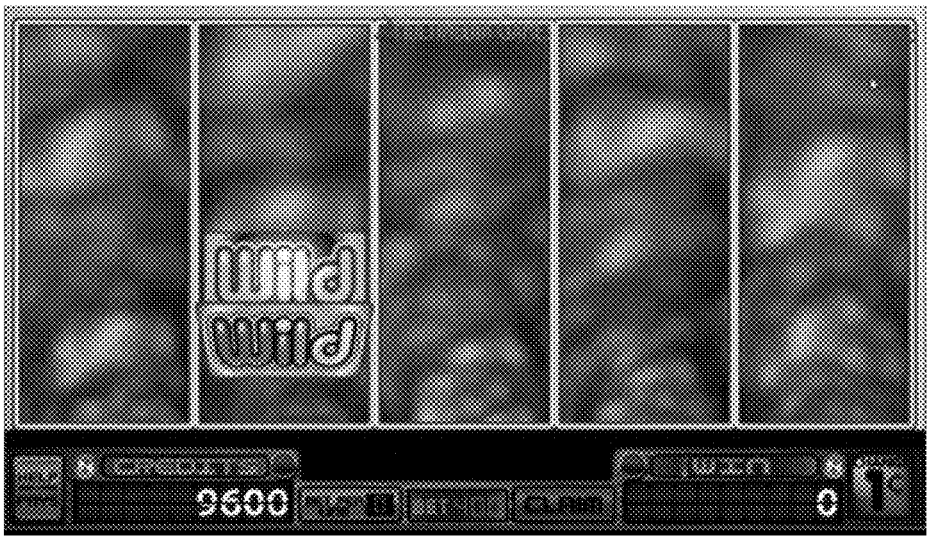

FIG. 1D is a game screen diagram showing the alternating wild symbol 1020 leaving a wild status behind where it landed in FIG. 1C, and changing direction to follow a path toward the bottom of the screen. The depicted change of direction is merely one option, and the actual direction of movement from each symbol location is determined by the game controller as will be further discussed below.

Figure 1E:
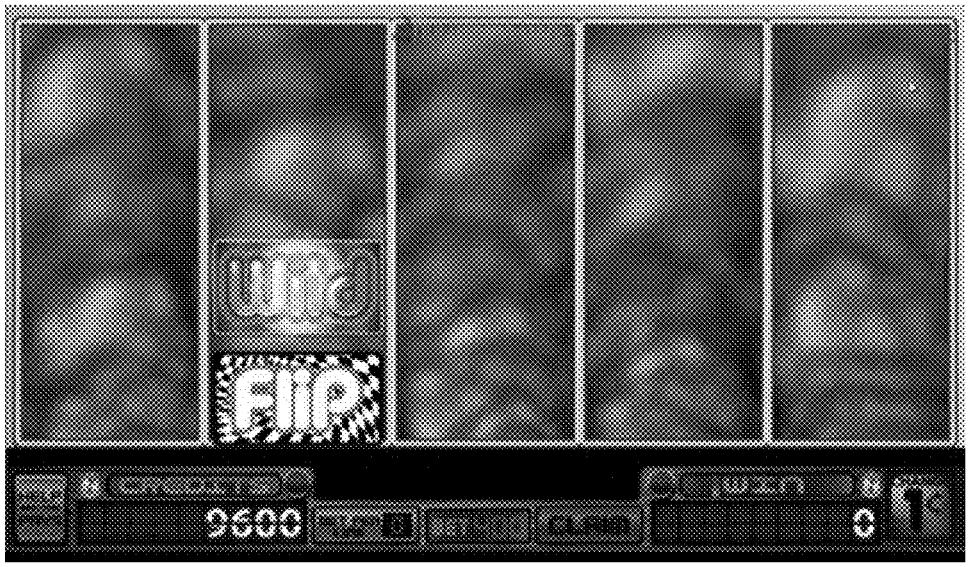
Figure 1F:
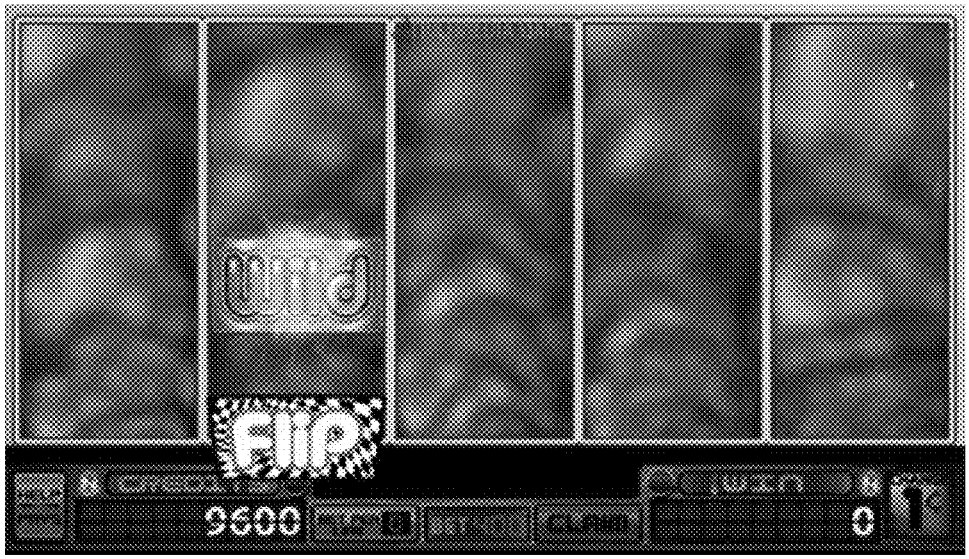

FIGS. 1E-F is a game screen diagram showing a continuation of the example path of the alternating wild symbol as it flips down again and moves off the screen. As shown in FIG. 1E, the alternating wild symbol 1020 has flipped over or alternated to show the flip side at the new location, and therefore does not deposit a wild status in the current symbol location. Instead, the alternating wild symbol continues to flip in a direction determined by the game controller, in this example, as shown in FIG. 1F, by flipping downward to leave the symbol array and thereby conclude or terminate the path of this alternating wild symbol.

Figure 1G:
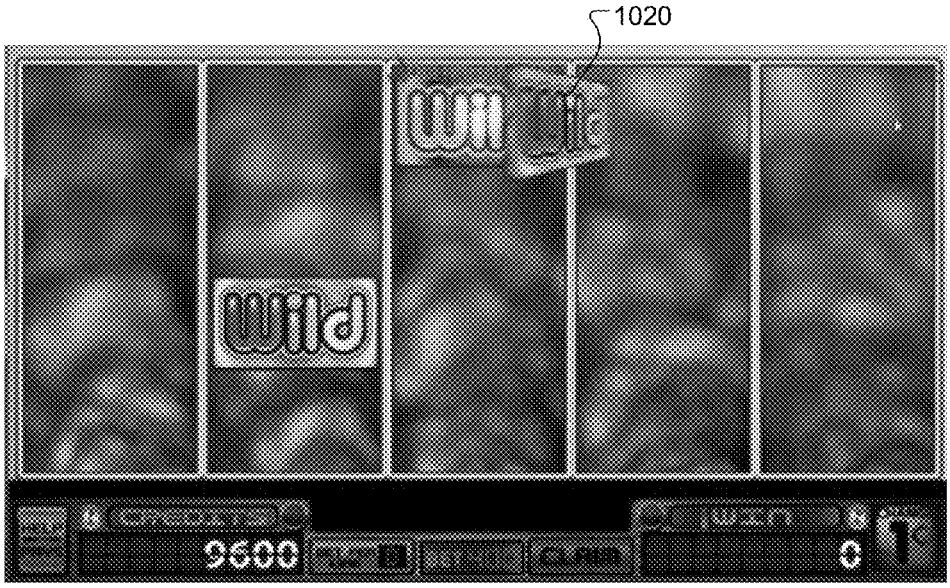

In one preferred embodiment, more than one alternating wild symbol 1020 may be employed during a particular game round. Continuing the example sequence described above, FIG. 1G is a game screen diagram showing a second example path of a second alternating wild symbol 1020. The depicted sequence includes the second symbol 1020 flipping onto the screen and depositing a wild status in the top symbol location of the center column, as depicted. The example animation in FIG. 1G shows the symbol 1020 in process of flipping off of the symbol location where it has just deposited a wild status. Again, the direction of each movement is shown for example only, and is determined by the game controller.

Figure 1H:
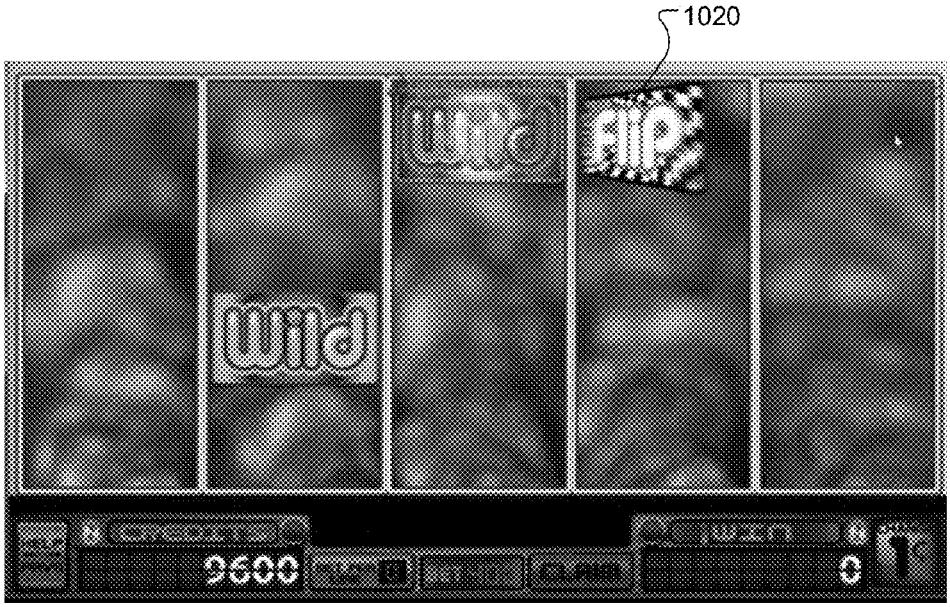

FIG. 1H is a game screen diagram showing a continuation of the second example path of the alternating wild symbol. In this example animation, the symbol is shown to flip over to the right and display its flip side, which does not change or alter the status of symbol location where the flip side lands.

Figure 1J:
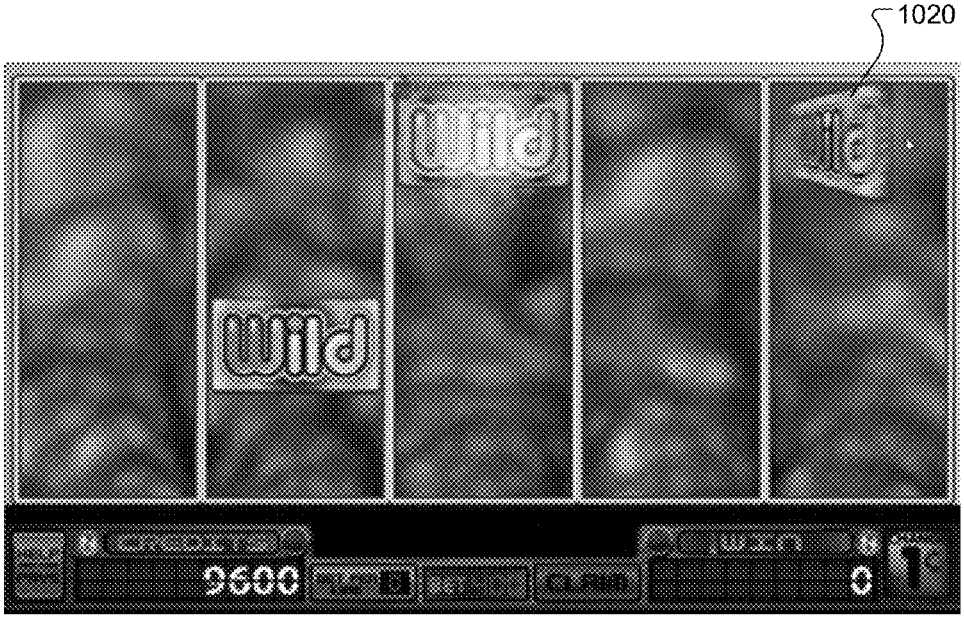
Figure 1K:
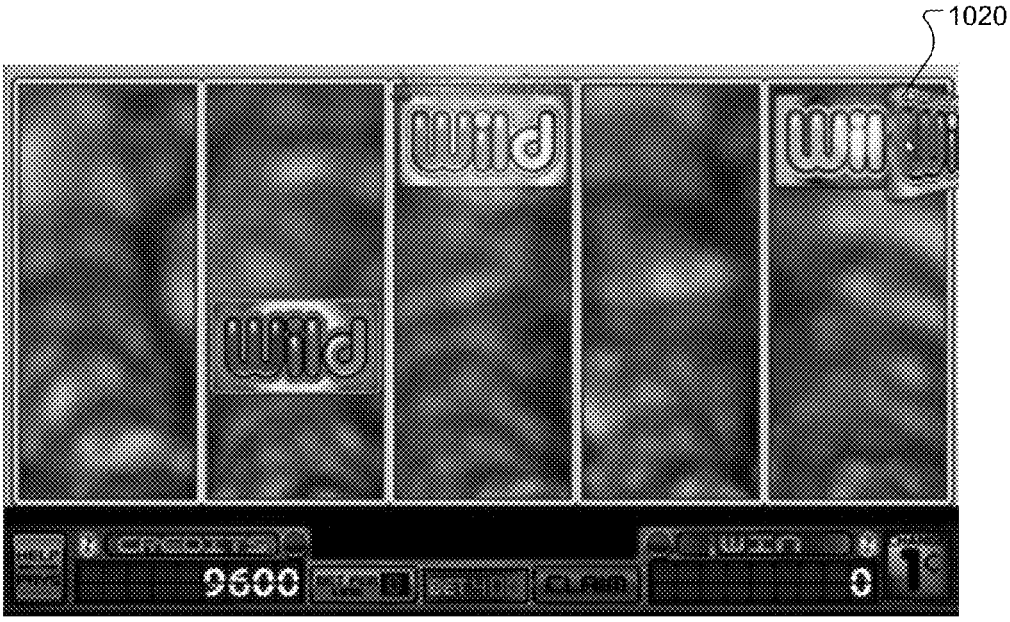

FIG. 1J is a game screen diagram showing a continuation of the second example path of the alternating wild symbol. In this animation, the symbol 1020 is shown to flip again to the right as it alternates to show the wild side, and thereby deposits a wild status in the top symbol location of the right-hand depicted reel. FIG. 1K shows the wild status left behind at this location as the alternating wild symbol 1020 continues to traverse a path on the depicted array of symbol locations. In this example, the symbol 1020 again moved to the right, as depicted in the drawing that shows the symbol flipping off the right side of the symbol array and thereby terminating or concluding this second example path for the alternating wild sequence of this particular example game play.

Figure 1L:
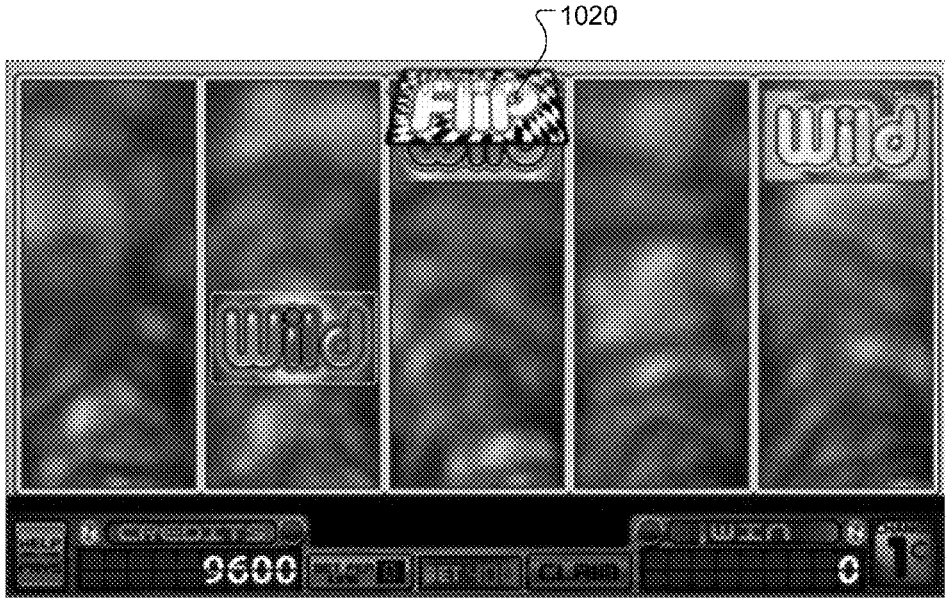
Figure 1M:
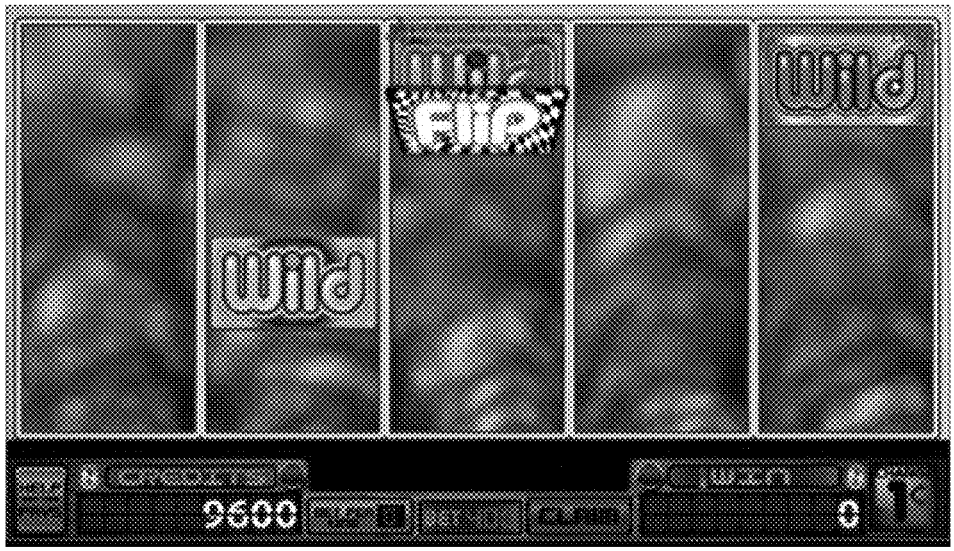
Figure 1N:
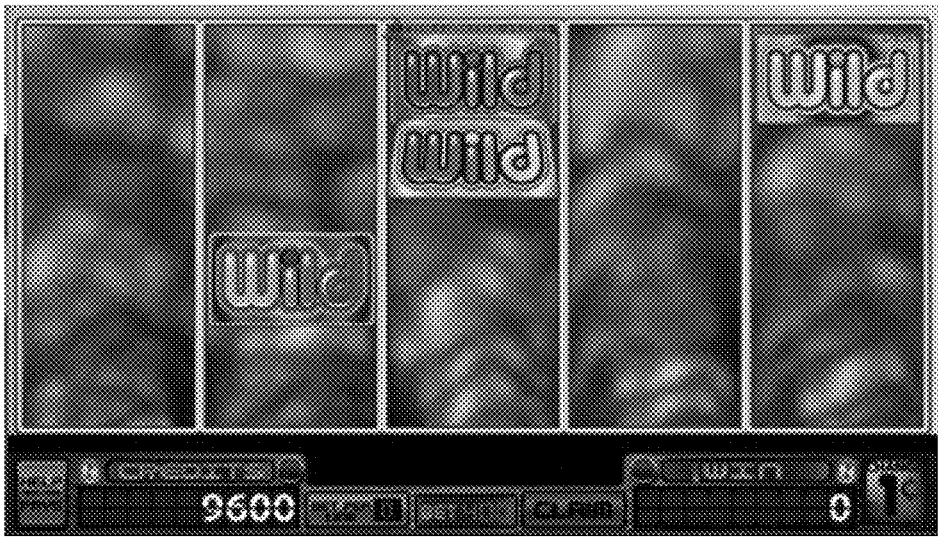
Figure 1P:
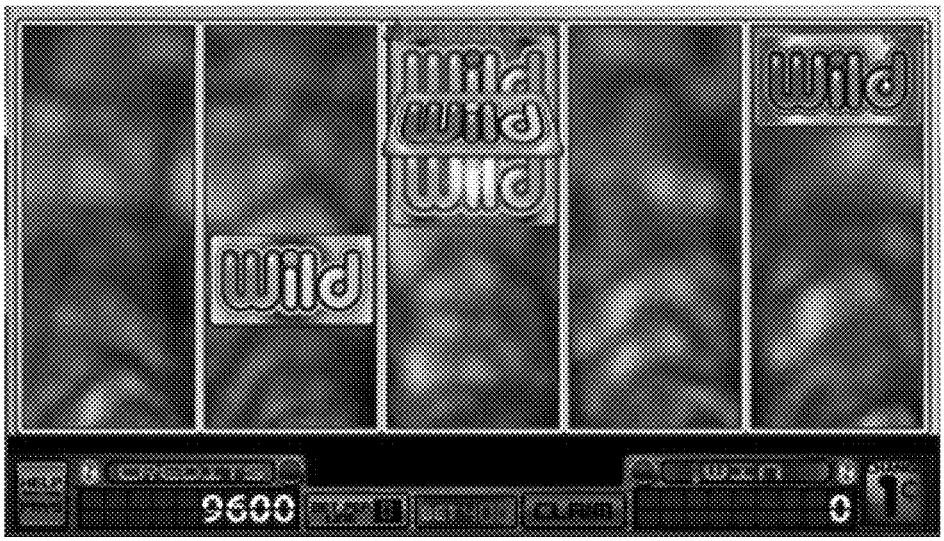

FIG. 1L is a game screen diagram showing a third example path taken by an alternating wild symbol, and continues the sequence of animations shown in the previous drawings. This third example path begins with an alternating wild symbol 1020 flipping or moving onto the screen over the top symbol location in the center reel. It is noted that this symbol location has already been given a wild status, but in this embodiment the alternating wild symbol is allowed by the game logic to flip over the symbol location having a wild status if the flip side of the symbol 1020 lands at that location, not the wild side. FIG. 1M shows the next animation in this example sequence, in which the symbol 1020 moves off of the location in which it previously landed, and flips downward. FIG. 1N shows the next animation in this example sequence, in which the alternating wild symbol flips over to show the wild side in the second symbol location in the center column. FIG. 1P shows the next animation in this example sequence, in which a wild status is deposited where the alternating wild symbol landed in the previous drawing. As depicted, in this example after depositing this wild status, the alternating wild symbol flips upward to again show the flip side at the top symbol location of the center column. This is only one example. Other directions of movement may, of course, be provided in any particular game result. In this example sequence, the symbol continued its upward movement and flips off the symbol array without depositing any further wild symbols.

This sequence includes three paths traversed by an alternating wild symbol. In this example, the animations are shown sequentially with a symbol appearing and traversing the path and disappearing before another symbol appears. This is only an example, and other versions may have multiple alternating wild symbols traversing the screen simultaneously.

Figure 1Q:
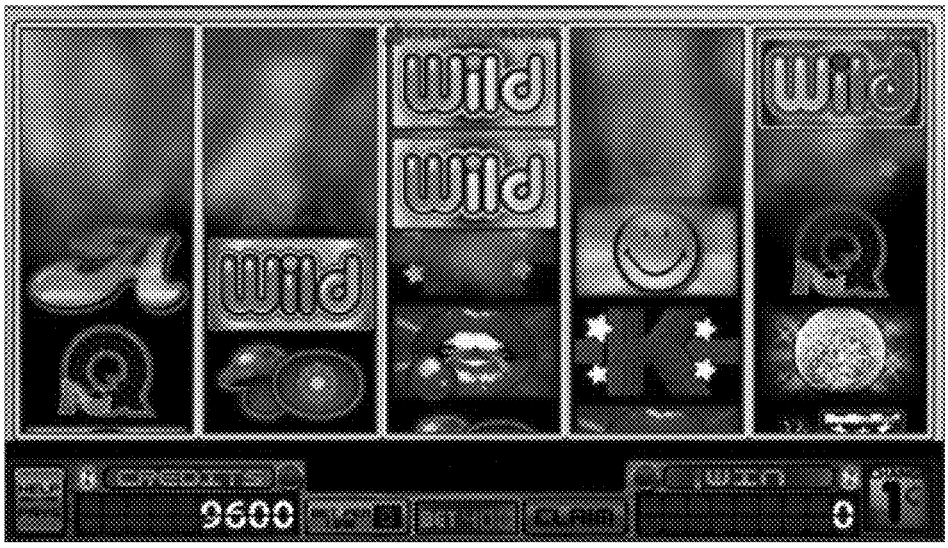

FIG. 1Q is a game screen diagram appearing after that of FIG. 1P in this example sequence, the diagram showing the matrix of symbol locations as the game removes the smoke-screen to show the spinning reels, and then begins to stop the reels to show the resulting symbols. As depicted, those locations that received a wild status from the alternating wild symbol maintain that status in the populated symbol array that is created by stopping the simulated reel spin or other symbol rearrangement process.

Figure 1R:
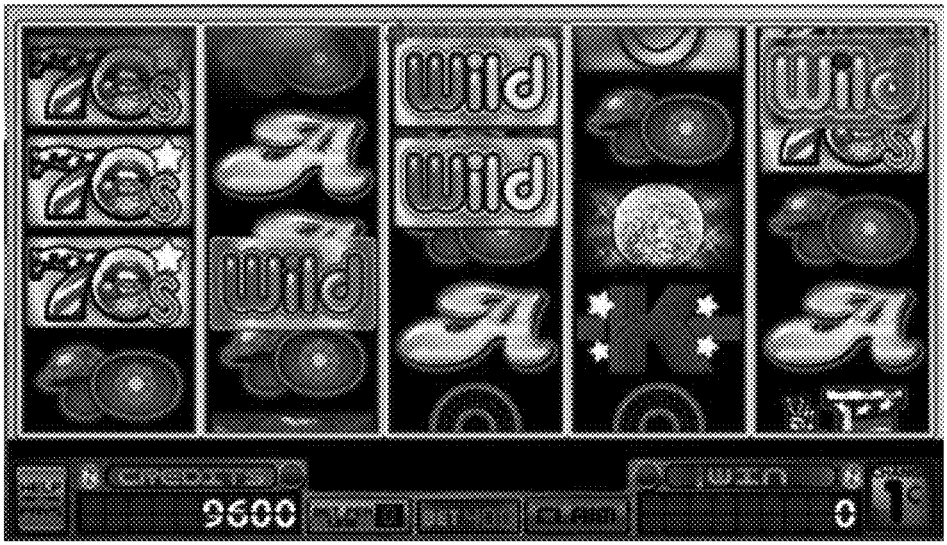

FIG. 1R is the next game screen diagram in the sequence, which shows the matrix of symbol locations appearing with finalized symbols in the left-hand column of symbol locations, as the remaining columns are depicted as continuing to spin. While in a preferred version, the array of symbol locations is populated by stopping one reel at a time from right to left to create player excitement, any other suitable method of displaying results may be used.

Figure 1S:
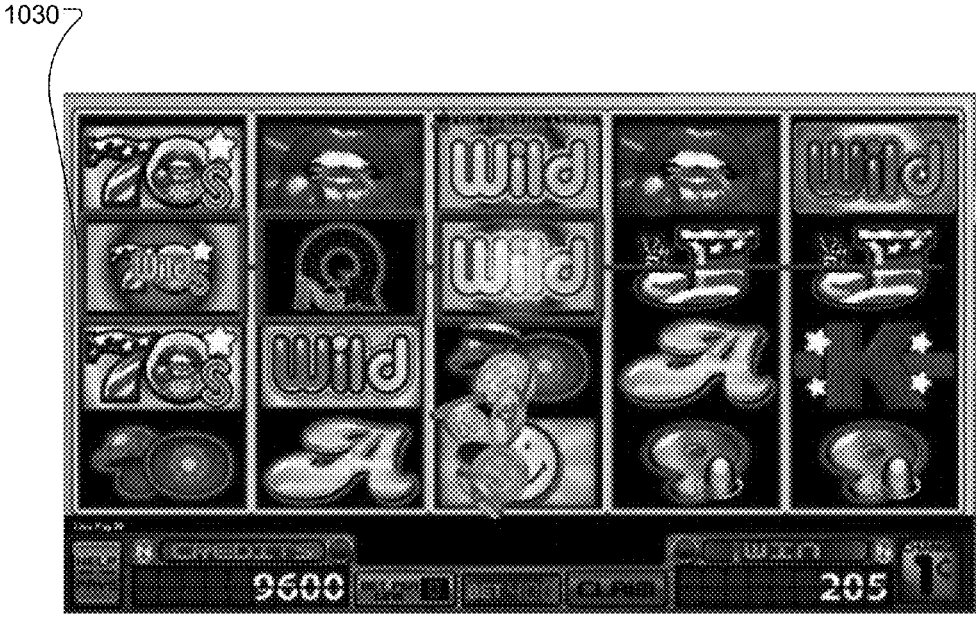

FIG. 1S is a game screen diagram showing the final matrix of symbol locations after the game has populated the symbol locations with the example set of game symbols. The symbol array is then evaluated for winning paylines and patterns, such as the example winning payline shown formed using one of the wild status locations deposited previously in the sequence by the alternating wild symbols.

Figure 1T:
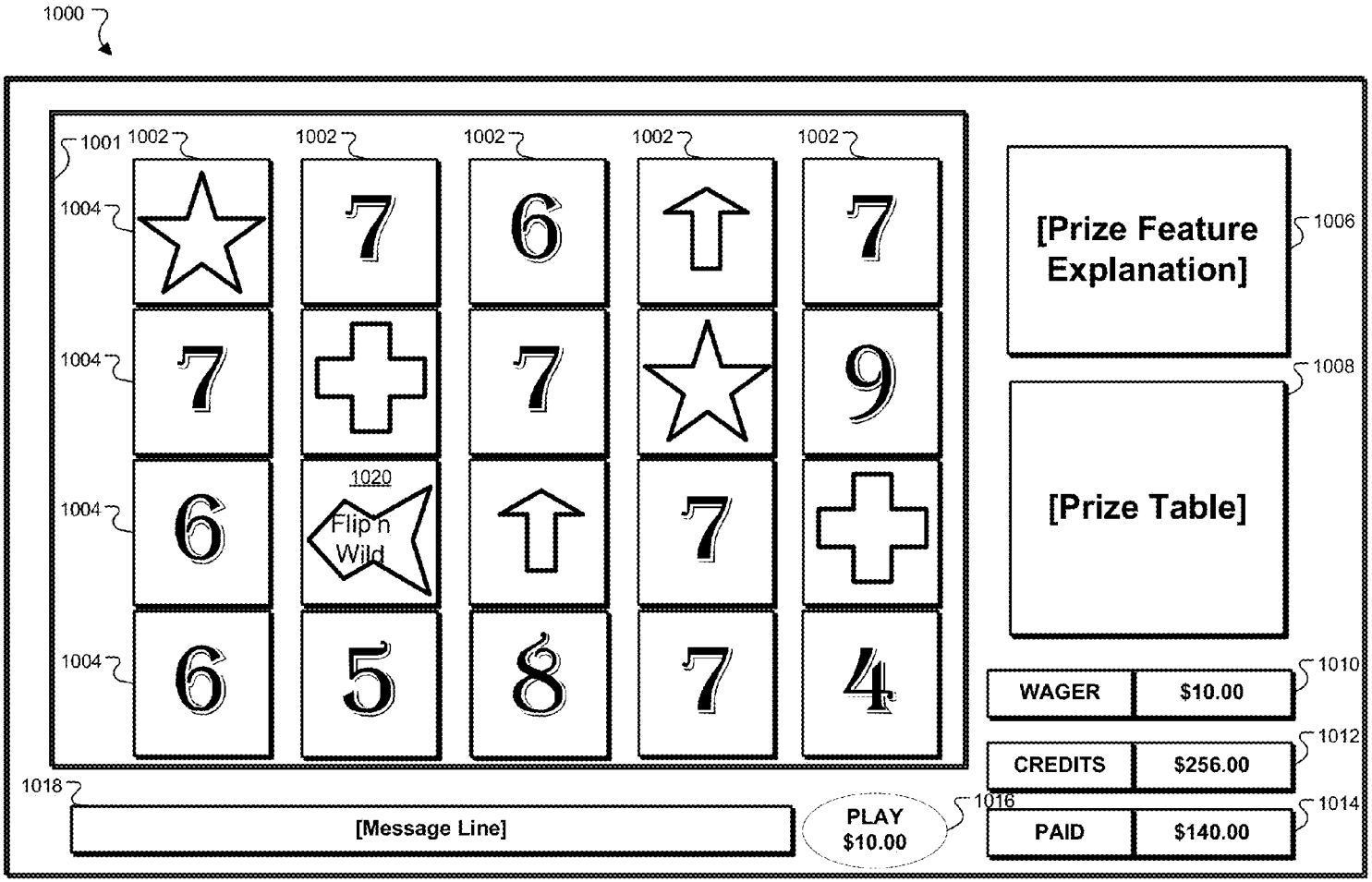
FIGS. 1T-1V are an example series of game screen diagrams according to another embodiment in which the alternating wild symbol may appear in the base game reel spin.
Figure 1U:
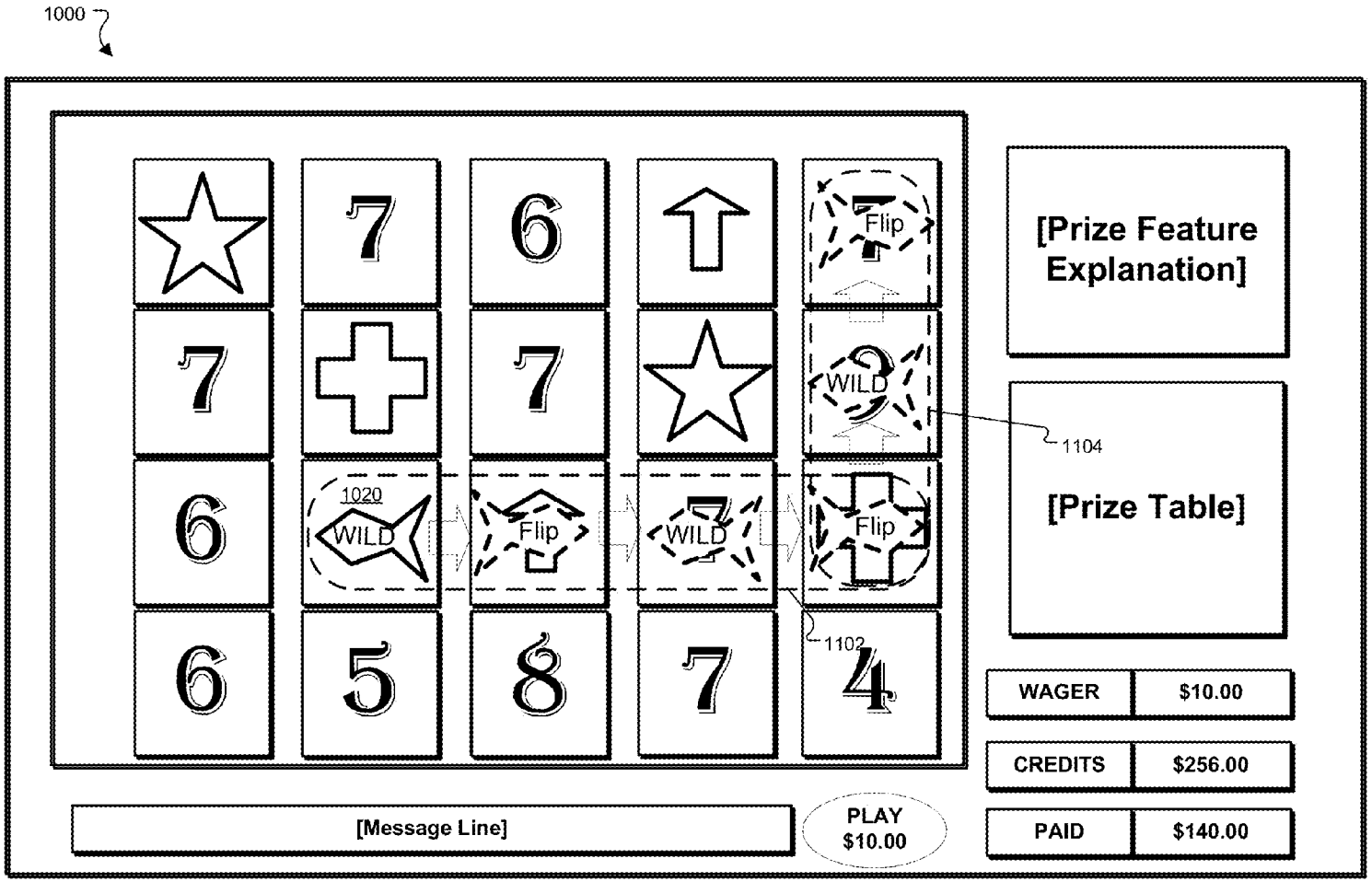

FIGS. 1T-1U are an example series of game screen diagrams according to another embodiment in which the alternating wild symbol may appear in the base game reel spin. FIG. 1T shows an example game screen diagram 1000, which may be displayed at various gaming machines 100 including gaming system 300 shown in FIG. 4A. In this embodiment, the graphics display includes a matrix of symbol locations 1001 that displays symbols in four locations 1004 on five separate reels 1002. The graphic display 1000 also includes a box 1006 for displaying texts regarding prize features. There may also be displayed a prize table 1008. A group of accounting indicators at the lower right displays various pieces of data such as the current wager box 1010, available credits 1012, and/or payouts 1014. The touch screen play button 1016 also displays the wager for each game 1016. A message line 1018 displays messages concerning game progress, results, and related information.

In this embodiment of the invention, a slot machine reel game employs the alternating wild symbols that appear in the base game play or the bonus game, these wild symbols having special properties and rules similar to those discussed with respect to the first example in which the alternating wild symbols appear and flip across the screen. Depicted in the base game result shown in matrix 1001 is one such alternating wild symbol 1020, a fish symbol marked with the trademark Flip'n Wild (a trademark of Multimedia Games, Inc.). Alternating wild symbol 1020 has the function of transforming alternate symbols along a designated path, preferably beginning where the symbol appears, into wild symbols. In a preferred version this transformation is accompanied by animation of symbol 1020 flipping along the designated path. As it moves, the alternating wild symbol alternates or flips from a "flip" side to a "wild" side. In every reel position that the wild side lands, a wild status or wild symbol is left in place.

FIG. 1U is a game screen diagram illustrating a path traversed by the Flip'n Wild symbol of FIG. 1T. The depicted graphic display 1000 shows the game result of FIG. 1T with the instance of the alternating wild symbol 1020 depicted in the second reel. As depicted by the path marked by dotted regions 1102 and 1104, the alternating wild symbol 1020 has traveled along a path alternating between the flip and wild sides as it moves one symbol location at a time. This path is depicted in two parts. The first portion of the path shows movement to the right by the alternating wild symbol 1020, and is marked 1102. The second part of the path is marked 1104, which represents movement toward the top of the array. Although in this instance there is only one change of direction, this is not limiting and various embodiments use paths in which the direction of movement can change at each flip or change in other manners.

Figure 1V:
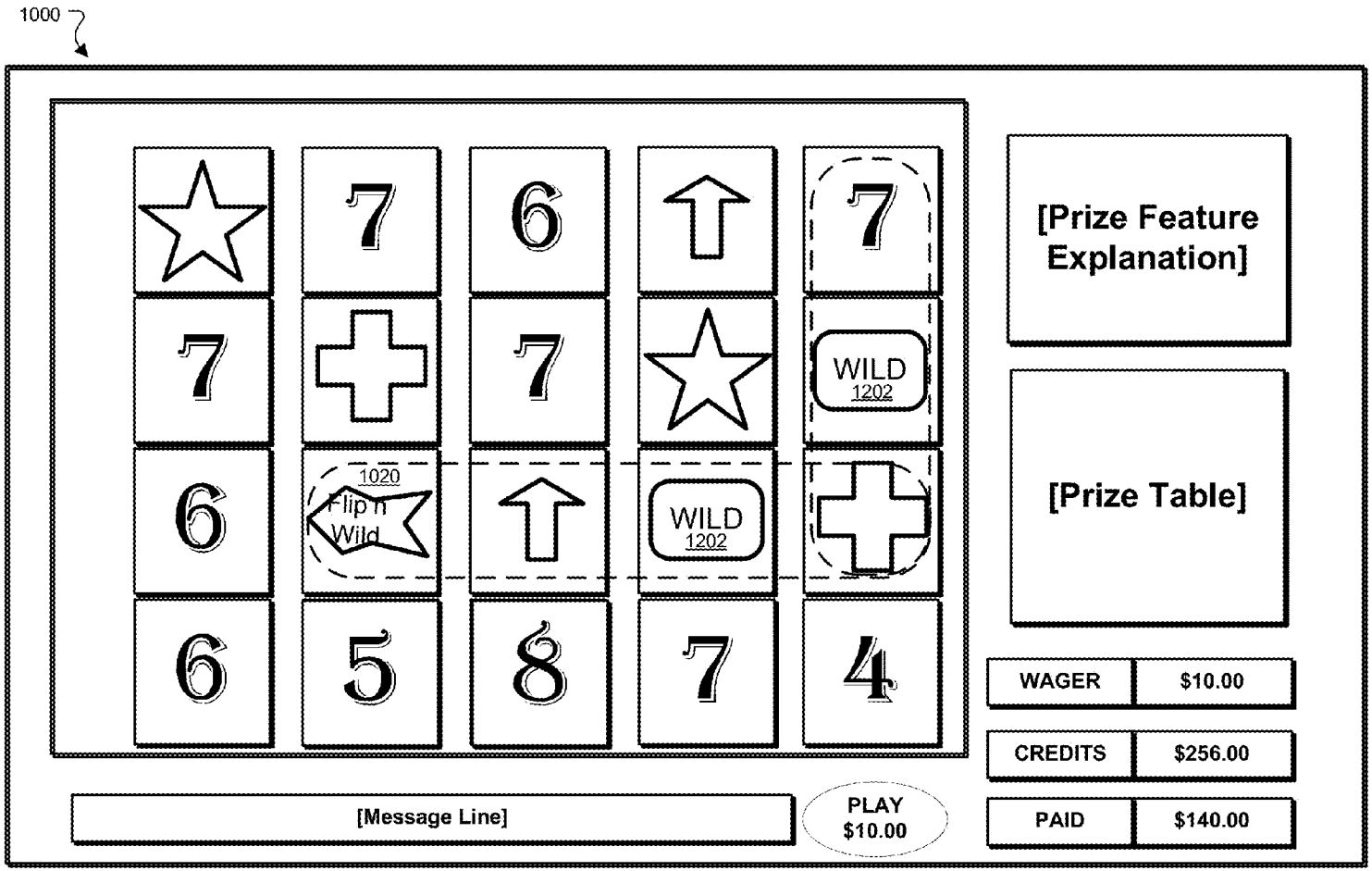

FIG. 1V is a game screen diagram following that of FIG. 1U and showing which symbols in the path of the alternating wild symbol 1020 are converted to wild symbols 1202.

Figure 1W:
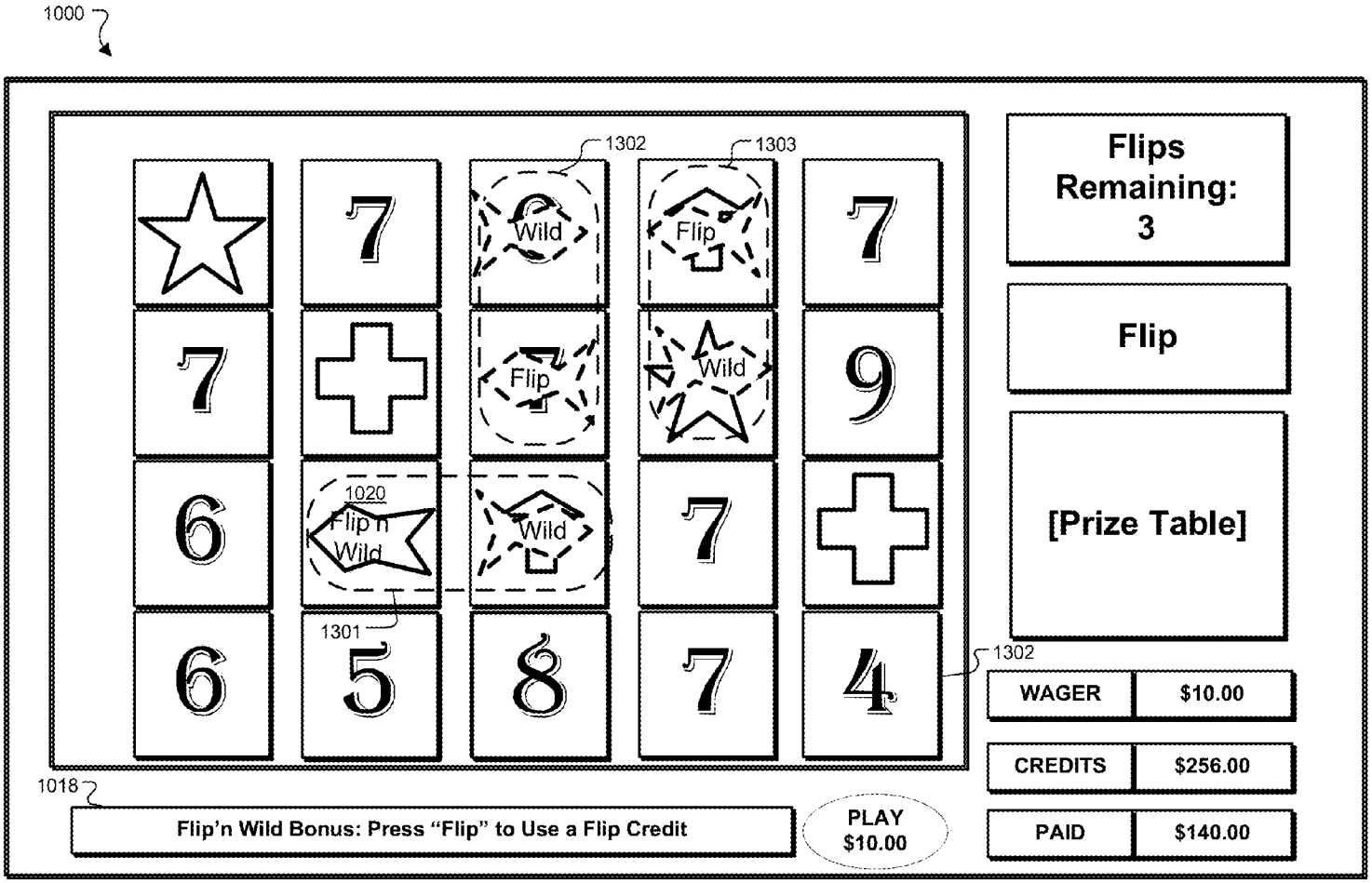
FIG. 1W is a game screen diagram according to another embodiment.

FIG. 1W is a game screen diagram according to another embodiment of the invention. In this embodiment, an alternating wild symbol is employed in a bonus round providing player interactivity. The player is given a number of "flips" which can be activated to alternate or flip the alternating wild symbol from its current location to a new location. In some versions, the flips may be earned by collecting special symbols that appear in the base game round. In other versions, the number of flips given may be randomly or pseudo-randomly determined at the start of the bonus round. In the depicted version, the number of flips are collected during base game play. Different variations of this scheme might activate the bonus round when a particular number of flips are collected, or may activate the bonus round with a specified pattern such as a scatter pattern. The bonus round as depicted is presented as a free spin in which an alternating wild symbol 1020 is guaranteed to appear. The dotted regions 1301, 1302, and 1303 represent portions of the path the alternating wild symbols flow. In the depicted scenario, the bonus round spins up a single Flip'n Wild symbol 1020 in the second column. The player then activates their "flips" to cause symbol 1020 to flip a number of times. In this example each flip produces one wild symbol, and the first flip may produce a wild or may show the flip side of symbol 1020 and then flip again to show a wild. Region 1301 shows the results of the first activated flip as the player uses one flip credit and the alternating wild symbol flips one location to the right and lands on its wild side, showing a wild status. At this point, it must flip to show the flip side before it can again show the wild side. Region 1302 shows the results of the player's second activation, in which alternating wild symbol 1020 flips upward twice, showing its flip side and then its wild side. Region 1303 shows the results of the player's third activation, in which symbol 1020 flips to the right from region 1302, and then flips down. Some versions may require the player to hit flip twice for each credit, once to alternate to the flip side and once to alternate to the wild side. Other versions may conduct both movements with a single input. Preferably, the path of movements is chosen randomly in the manner described above. Other embodiments such as Class II versions may use a predetermined set of movement directions. A reverse-mapped outcome may be employed if the game logic is aware of how many flips will be employed by the player. Therefore, Class II versions and other reverse-mapped gaming systems preferably require the player to use all of their collected flips within a bonus round, or provide a determined number of flips in a seemingly random manner within the bonus round if flips are not collected.

Figure 2A:
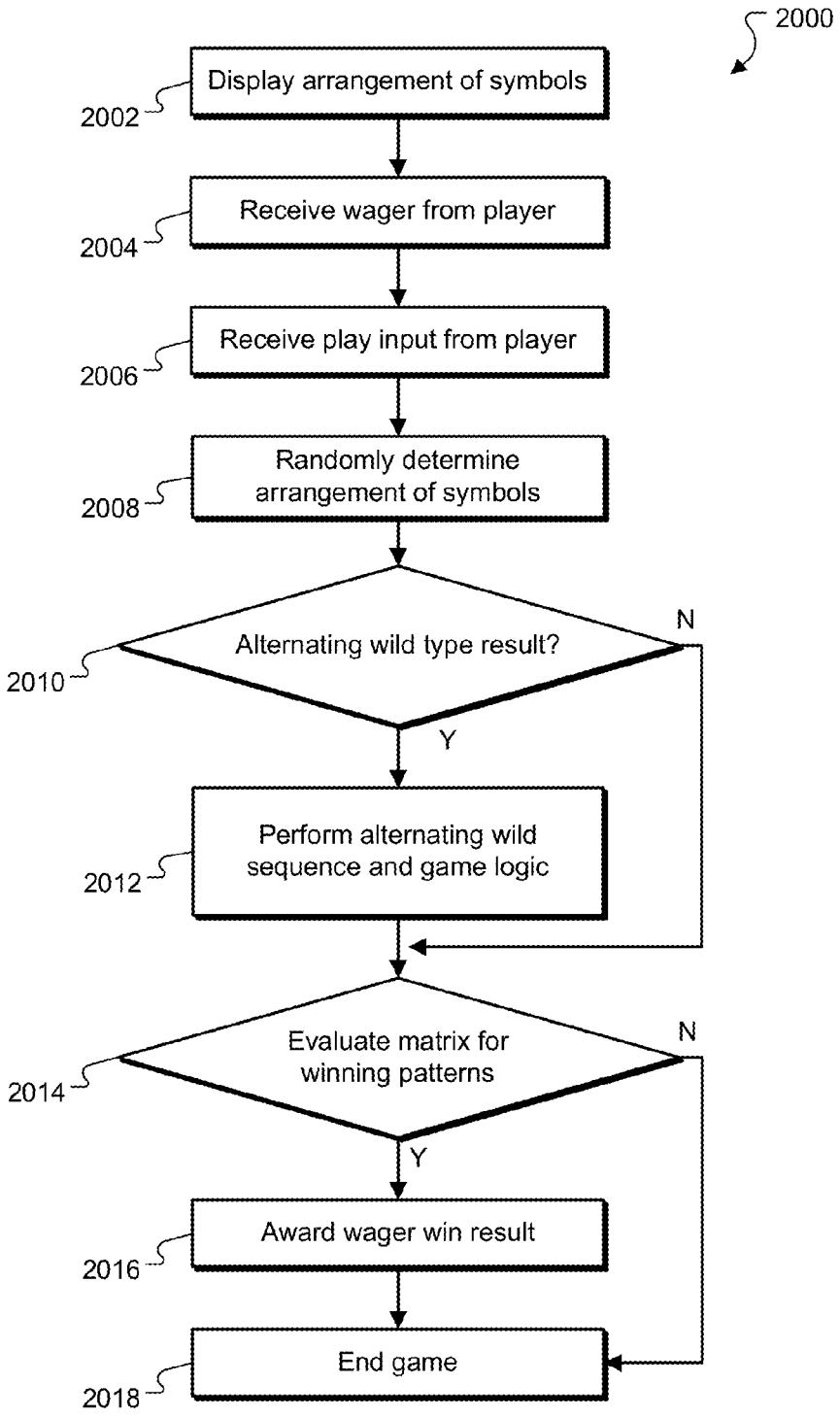
FIG. 2A is a flow chart showing an example game play process at a gaming machine that includes an alternating wild symbol.

FIG. 2A is a flow chart showing the general process of play at a gaming machine that includes an alternating wild symbol according to preferred embodiments of the invention. The depicted process preferably takes place in the context of the base game, as described above, but may also be employed in the context of a bonus game round. In fact, one preferred embodiment includes a bonus round of multiple free spins in which every free spin is guaranteed to have at least one alternating wild symbol. In such a case, step 2004 which receives a wager from the player, is obviously skipped for the free spins. Otherwise, the process is very similar between bonus free spin rounds and the base game round depicted in FIG. 2A.

The depicted process 2000 begins with displaying an initial state of the array which typically includes some arrangement of symbols in the symbol locations of the array (step 2002). Next, the process receives a wager from the game player at step 2004, which typically consists of some input from the player to set the amount to be wagered from their credit amount on the machine. This step may also be carried over from previous game rounds by simply starting the game with the previous wager amount set. Then, in step 2006, the process receives a play input from the player. This typically happens through a 'Play' button on the game cabinet or touchscreen display, and serves to place the wager and start a single round of game play in the base game. Next at step 2008, the process begins conducting the activated game by rearranging the symbols in the matrix. In embodiments having reels, reels displays, or simulated reels, this is conducted by spinning the reels. Other embodiments may otherwise rearrange or randomize the symbols on the matrix in any suitable manner.

At step 2010, the process checks if the current result is an alternating wild type result, that is whether it will include alternating wild symbols. In this version, the alternating wild symbols are not present as a symbol in the base game results, but instead flip onto the screen in the manner depicted in the example scenario in FIGS. 1A-1H, 1J-1N, and 1P-1S. Step 2010 may involve checking a random number generated for the game outcome against predetermined ranges or values that activate the alternating wild feature. In embodiments that employ a "true spin" of simulated reels, step 2010 may involve checking the reels for the presence of some activating pattern such as a special symbol or a scatter pattern. Further, in versions that allow the alternating wild symbol to appear in the base symbol array, this step involves checking for the presence of one or more alternating wild symbols in the spin result symbol array. Other versions may provide that every base game result has some alternating wild sequence. As another variation, where allowed by gaming regulations, a random number may be generated specifically for determining whether a particular result will have alternating wild symbols. This step may also determine how many alternating wild symbols will appear. Such determination may employ any suitable technique including those discussed above such as true-spin, single random numbers, trigger symbols or a variety of scatter patterns that trigger different number alternating wild symbols, or the number of alternating wild symbols based on a separate random number or other random determination.

In some embodiments, the software executing the process may, of course, already have available some indication that a special wild symbol will be part of the game outcome, because some embodiments employ reverse-mapped outcomes generated from randomly selected prizes, or otherwise create outcomes from prizes and not directly based on an array of random symbols. For example, some embodiments reverse-map the outcome from Class II bingo game results which are operable with reduced regulatory and tax requirements in certain gaming jurisdictions. Other embodiments may select outcomes from a bank of predetermined outcomes such as electronic lottery tickets. Variations that employ reverse-mapping are further described with regard to FIG. 2C. The particular method of generating a randomized outcome of the base game is not important. Referring again to FIG. 2A, if the base game result is designated as a special wild type result, the process goes to step 2012. If not, the process skips to step 2014. In some versions, a special wild type result will include special wild symbols in the initial spin results of the base game, while other versions will not, as discussed above.

Referring to step 2012, if the result is an alternating wild type result, the process conducts the display of alternating wild symbols that travel onto the screen in a manner such as that described with regard to FIGS. 1A-1H, 1J-1N, and 1P-1S. Preferably, this step includes displaying some type of graphic sequence indicating that the transformations are taking place in order to build the excitement of playing the game. Preferably, at the end of this step, the transformed symbols are left with some visual indication that they have been turned wild, such as, for example, wild or some other special graphics added to the symbol, such as the wild graphics left in place in the graphic sequences depicted in FIGS. 1A-1H, 1J-1N, and 1P-1W. The process of determining the path that alternating wild symbols travel on the screen and displaying their effect is further described with regard to FIG. 2C.

Next at step 2014, the process evaluates the matrix for winning patterns using the wild status resulting from the alternating wild symbols. This evaluation preferably employs a plurality of pay lines according to well-known slot machine game techniques; but this is not limiting and other versions may use other prize evaluation schemes or combination of schemes to determine the presence winning patterns. At step 2016, the process confers any resulting awards to the player, and then ends the game round at step 2018.

Figure 2B:
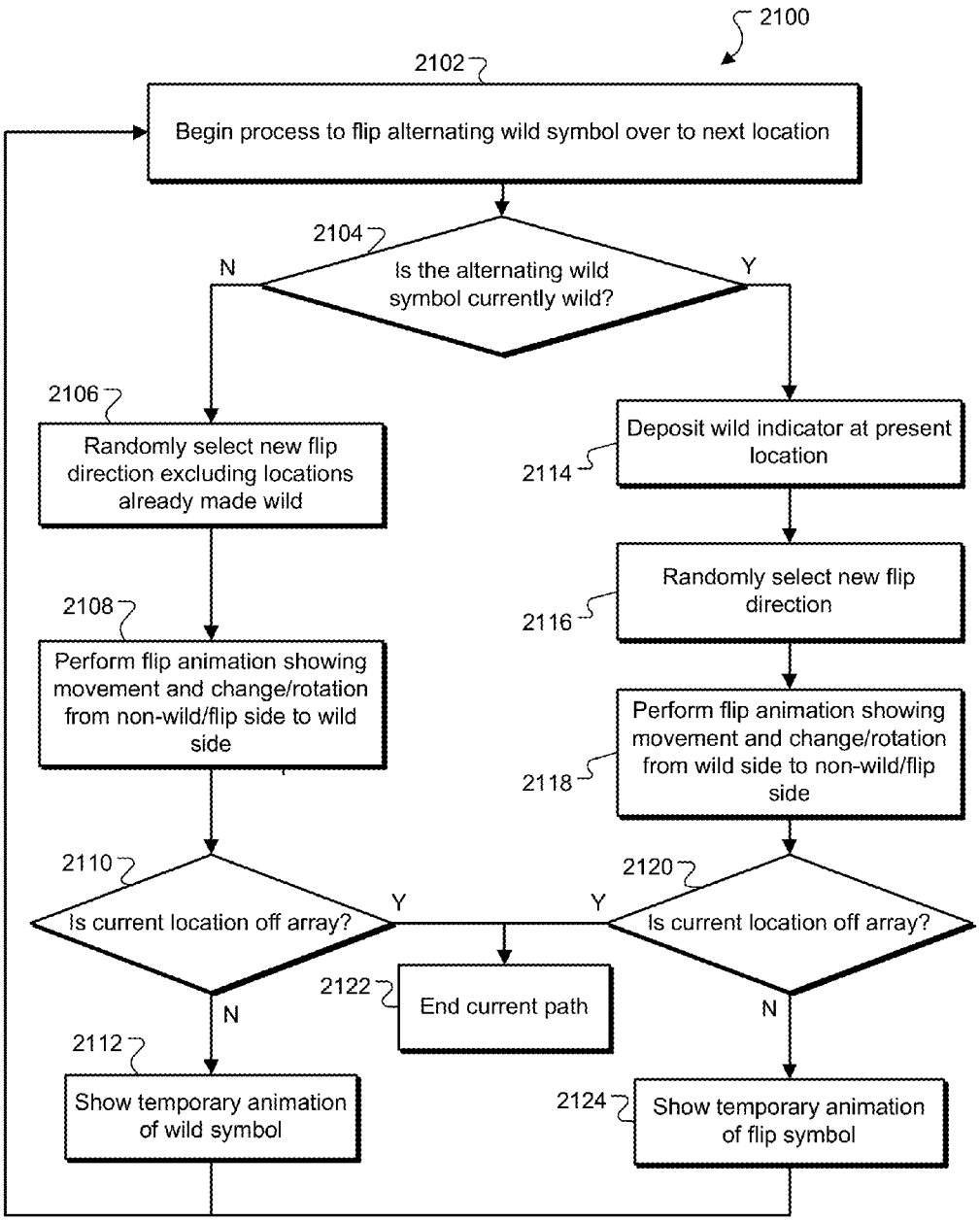
FIG. 2B is another flow chart showing an example process of implementing an alternating wild sequence.

FIG. 2B is a flow chart showing an example process of implementing an alternating wild sequence. The process 2100 shows the steps of deciding and controlling what direction the alternating wild symbol will take as it moves along screen. The process shows a series of steps that are repeated for each movement of the alternating wild symbol to an adjacent symbol. This example process may be used in game versions where the alternating wild symbols flip onto the screen, traverse the screen, and then flip off of the screen. It may also be used in versions in which the alternating wild symbol may appear in the array, but then traverse the screen and move off of the screen.

The depicted process begins at step 2102, where it begins to flip a new alternating wild symbol over to a new location. At this initial step 2102, if the symbol is brand-new, as it first enters the screen, it will be given the location preferably chosen at random by the game controller where it is to appear on the periphery of the symbol array. It is also given a starting state of either flip or wild (for example, FIG. 1B shows an alternate wild symbol that is initialized in its wild state off the screen, and then alternates to the flip state during its first movement onto the screen). The current state of the alternating wild symbol is employed at step 2104 to decide how to process the next movement of the symbol. If the alternating symbol is currently wild, the process moves to step 2114, where it deposits a wild indicator at the symbol's current location before movement. Obviously, if the symbol is moving on to the game array, the symbol is typically not deposited outside of the game array, therefore this step would be skipped for the first movement of a symbol onto the symbol array. Next, at step 2116, the process randomly selects a new flip direction in which to move or flip the alternating wild symbol. After selecting the new flip direction, the process at step 2118 performs a flip animation showing the movement of the symbol and the selected direction and showing the animation of the change, rotation, or flipping movement that alternates the symbol from its wild side to its flip side or non-wild side.

Next, at step 2120, the process checks if the new location is off of the symbol array. If so, the process goes to step 2122, where the current pattern is ended. At this point, if multiple alternating wild symbols are used in the sequence, a new symbol path may be started for a new symbol. Otherwise, the sequence concludes, and the game proceeds to evaluate the symbol matrix. If at step 2120 the current location is not off of the array, the process must continue to flip the alternating wild symbol until it moves off of the array. Therefore, the process goes to step 2124, where it shows a temporary animation of the symbol in its flip state, and then proceeds to step 2102 to repeat the depicted process starting at the new symbol location. While this embodiment ends each particular path taken by alternating wild symbols by flipping the symbol off of the symbol array, other embodiments may use another method of ending the path at steps 2110 and 2120. For example, some embodiments may use a fixed number of flips for each symbol, after which the symbol stops on the array. The number of flips may vary between symbols. Other embodiments may use some type of accrued player points or tokens collected during other game rounds to determine the number of flips.

At this point, after going through the right-hand depicted branch of the process, the alternating wild symbol will have changed its state from wild to flip, or non-wild. Therefore the branch decision at step 2104 will answer no and the process goes to step 2106 to enter the left-hand depicted branch, where it randomly selects a new direction to flip the alternating wild symbol. Because the alternating wild symbol is currently showing its flip side, the next alternation will show the wild side. The process at this step therefore excludes from possible movement any symbols that have already been made wild by an alternating wild symbol. This is not limiting, and other versions may allow an alternating wild symbol to confer wild status at a symbol location already made wild, thereby activating a 2× Wild or 3× Wild feature which includes a 2× or 3× prize multiplier, or some other similar feature. However, preferred versions do not allow alternating wild symbols to alter a location twice, because the preferred base game symbol set includes a base wild symbol. This base wild symbol is transformed into a 2× Wild (a wild with a 2× multiplier) when an alternating wild symbol deposits a wild status on it.

After choosing the movement direction, the process at step 2108 performs the flip animation showing the alternating wild symbol flipping a rotating from the flip, or non-wild, side to the wild side. Next, if the current location is off the array, meaning that the symbol has flipped off the array and concluded its path, the process at step 2110 goes to step 2122 where the current path is ended and the symbol animation sequence is concluded with some appropriate animation signifying the end of the path. Next, the process goes to step 2112 where it shows a temporary animation of the wild side of the alternating wild symbol added lands in the selected location. Next, the path of movement for the alternating wild symbol continues to build by returning back to step 2102 to begin the process of alternating to the next location.

Figure 2C:
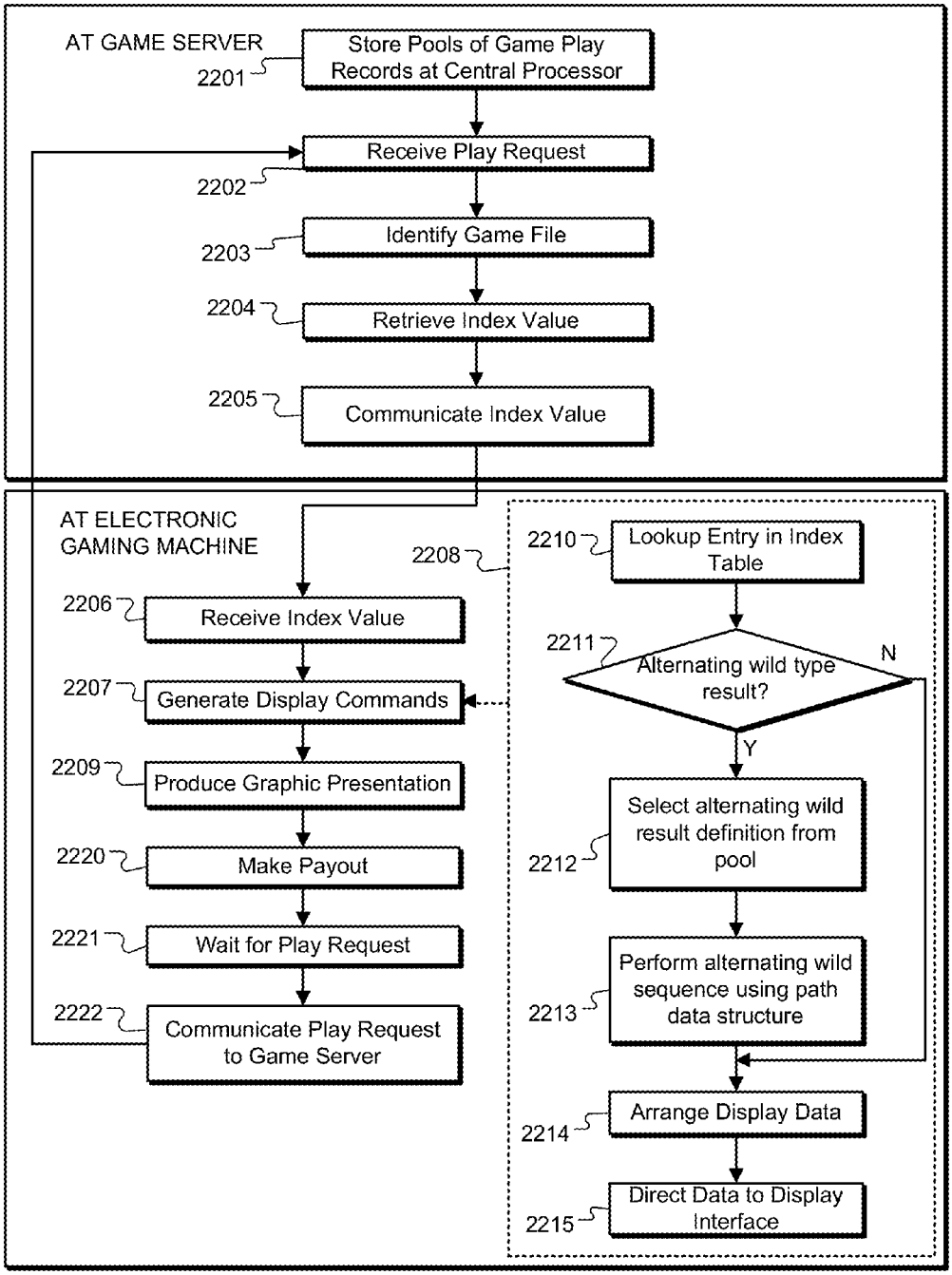
FIG. 2C is a flow chart showing another example game play process, this example including reverse-mapping of game results to a set of predetermined alternating wild symbol paths.

FIG. 2C is a flow chart of an alternate embodiment of the general process of play at a gaming machine. This embodiment may be used with Class II bingo game results or other types of systems such those that use predetermined outcomes known as electronic lottery tickets. It may also be used with Class III systems that generate a single random number and reverse-map a resulting game presentation based on that number. Generally, in the depicted process the result is determined or selected by a game server or central determinant server (See FIG. 4B). Then a suitable game sequence, including real spin results and an alternating wild symbol sequence, is reverse-mapped to the existing result in order to present a game that flows with a similar game process to a true spin game from the player's point of view.

Figure 4A:
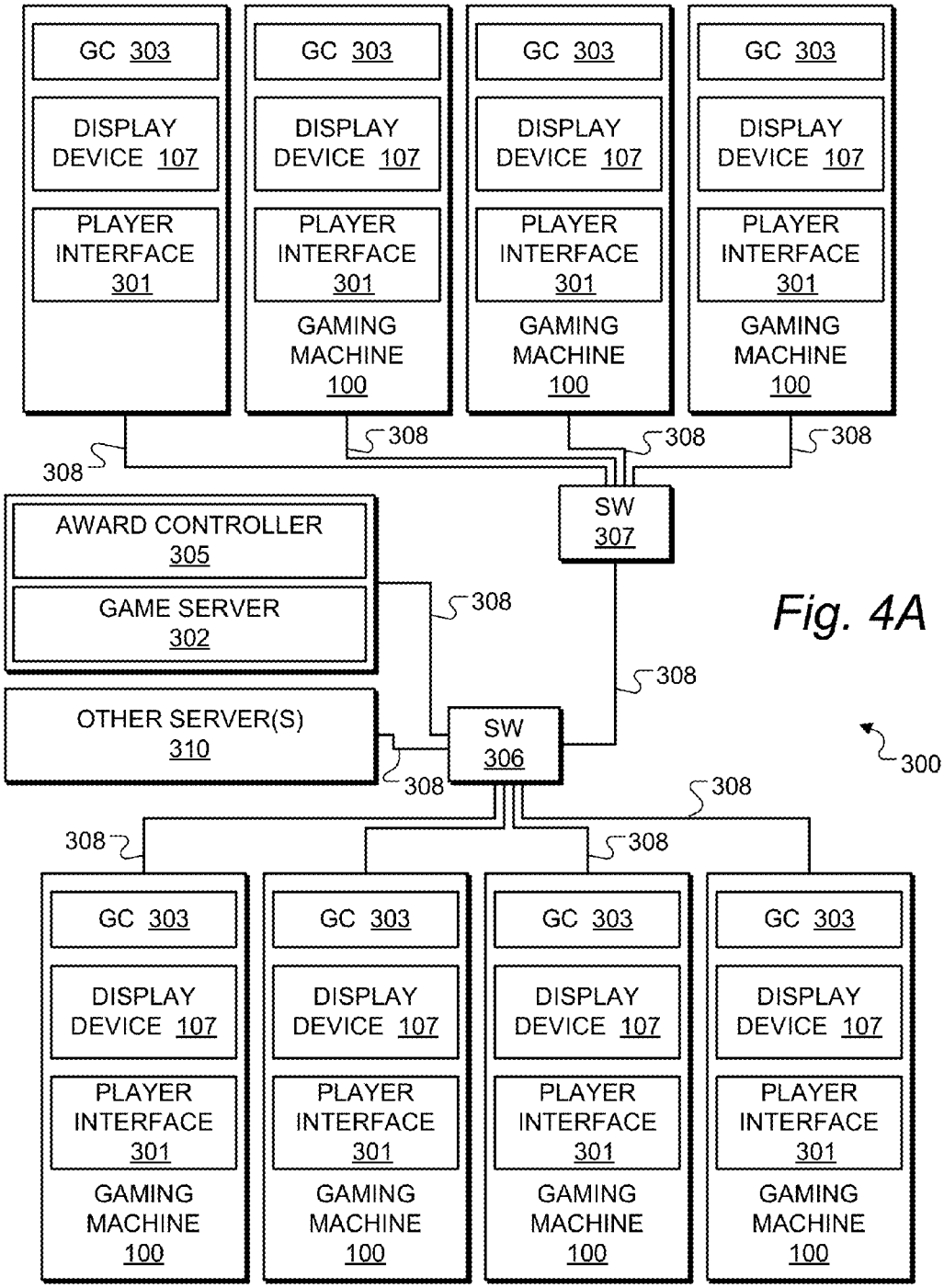
FIG. 4A is a system block diagram of a gaming system according to one embodiment of the present invention.
Figure 4B:
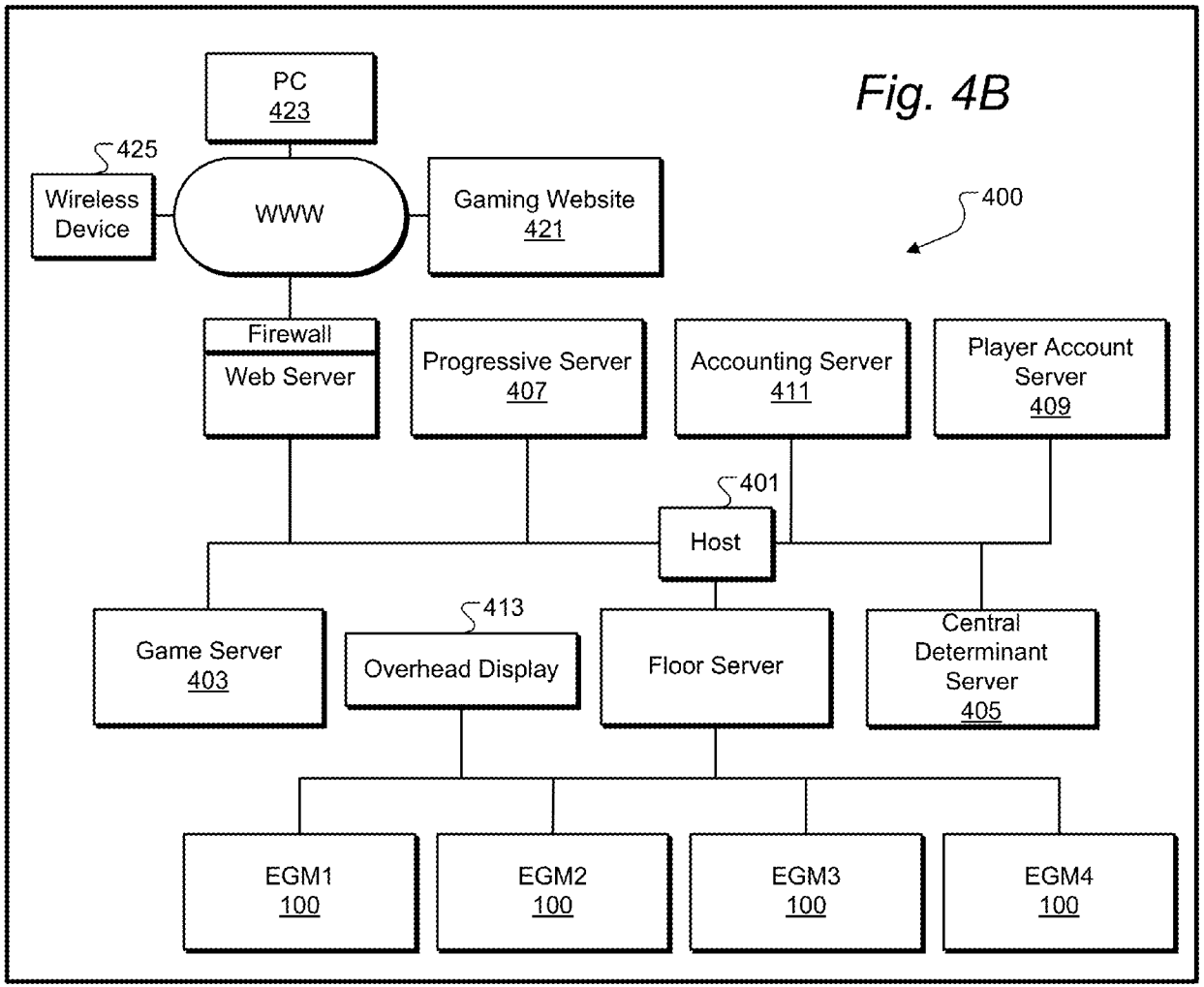
FIG. 4B is a system block diagram of a gaming system according to another embodiment.

The flow chart shown in FIG. 2C is divided into boxes, the top box labeled "at game server" indicates that part of the method is performed at the game server 302 and award controller 305 (FIG. 4A), or in another example network configuration version at the game server 403 or central determinant server 405 (FIG. 4B). The lower box indicates that the remainder of the method is performed at the electronic gaming machine 100. It should be understood that this is only one example embodiment, and other versions may divide the processing tasks of the game process in a different manner. For example, some systems may employ a thin client architecture in which practically all of the processing tasks are performed at the game server, and only display information for the player interface transmitted to the electronic gaming machine. In such an embodiment, only steps 2209, 2220, 2221, and 2222 are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring "at the gaming machine." In the depicted method, the process is performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (i.e. 302, 403). At the game server, the method includes storing one or more pools of game play records as shown at step 2201 in FIG. 2C. The pools of game records may be embodied in computer files or other suitable groups of data structures, each file containing a series of game play records for a particular game. As shown at step 2202 in FIG. 2C, the method performed at game server further includes receiving game play requests originating from an electronic gaming machine (for example, gaming machine 100 shown in FIG. 4A). In the preferred form of the invention, several games may be played at a given time and therefore several different game record files will be stored at game server. Where several game record files are available, the method includes the step of determining which game record file is to be used in response to the play request. This game record file determination step is shown at step 2203 in FIG. 2C. This step involves using information from the play request to identify the appropriate game record file.

For example, in the preferred form of the invention, a play request from electronic gaming machine 100 (FIG. 4A) includes the game index value. Each different game index value is associated with a different game to be played and thus corresponds to a different game record file identifier and different game record file. In a preferred implementation, the game record index values comprise the game file identifiers, and the step of determining the appropriate game record file comprises simply reading the received game index value to identify the associated game record file. Otherwise look-up tables may be used at game server to relate a received game index/game play request to a particular game file identifier and game record file.

Once the particular game record file has been determined, the central processor program code causes the record index associated with the next available game record to be retrieved as shown at step 2204. The program code then, at step 2205, causes the game server to communicate the retrieved record index to the electronic gaming machine 100.

Several different index tables may be stored at electronic gaming machine 100, each identified by a different index table identifier. Where different index tables are used at electronic gaming machine 100, the method at the gaming server includes retrieving the index table identifier associated with the particular record index along with that record index. This index table identifier is then communicated to electronic gaming machine 100 along with the record index at step 2205.

Figure 2D:
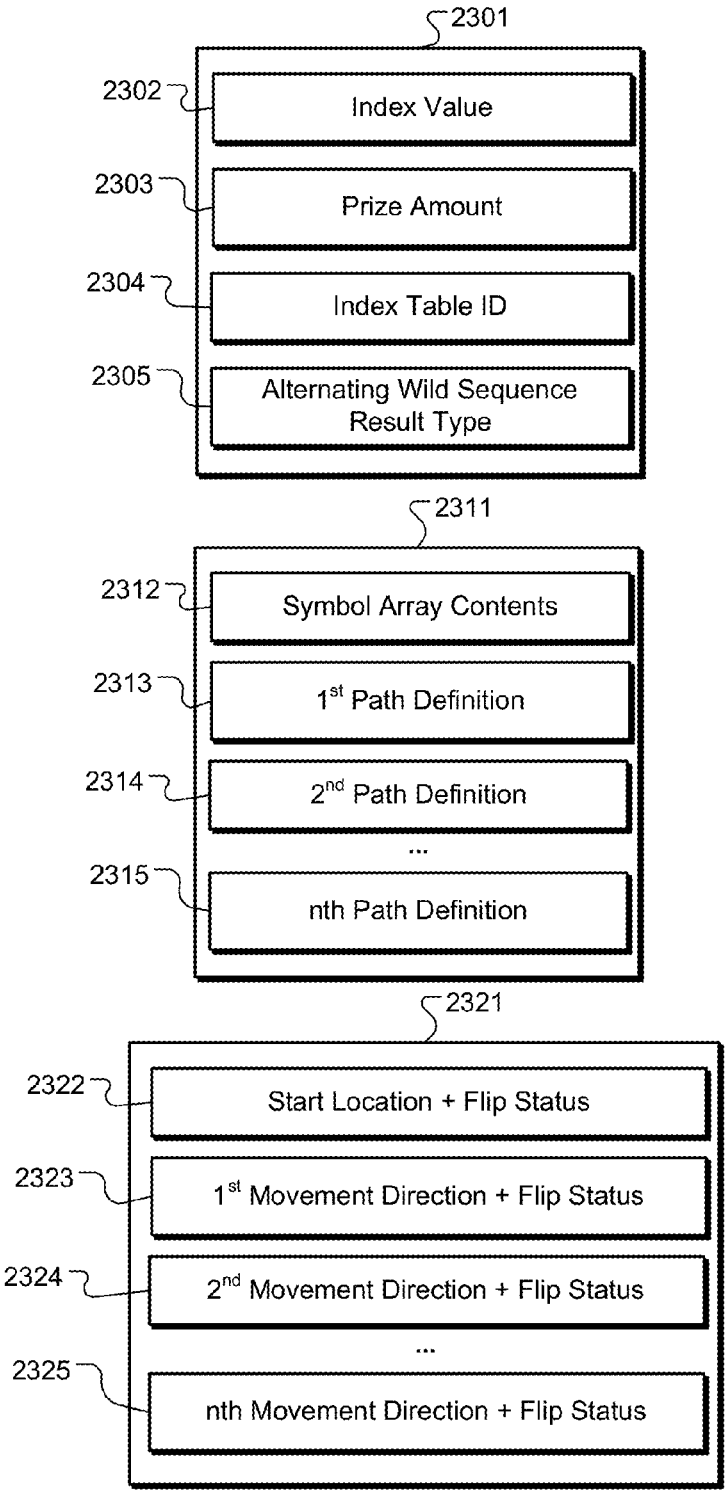
FIG. 2D shows block diagrams of three different data structures employed in one example reverse-mapping embodiment.

The method steps performed at electronic gaming machine 100 include receiving the record index communicated from game server, as shown at step 2206 in FIG. 2C. At step 2207, the process next generates display commands in response to the received record index. This method step is performed by display control program code executed at electronic gaming machine processor 205. The display commands are generated by a reverse mapping process to present the game sequence to the player as if the game logic were occurring at the moment, instead of being a selected one of a group of predetermined animated sequences. The reverse mapping process is shown in more detail in the sub-process surrounded in the figure with the dotted box labeled 2208. Sub-process 2208 is shown by the dotted arrow as providing output to step 2207, which generates the display commands to display the animated sequence presenting game results to the player. The reverse-mapping process employs the index value associated with the current game result, and in a preferred embodiment uses that index value to access several data structures employed in displaying the alternating wild symbols moving along their respective paths. One example design of the data structures is depicted in FIG. 2D. The use of the data structures by sub-process 2208 will be further described below. Generally, the process 2208 produces display commands, which are then directed to graphics processor 215 to produce the desired graphic representation at step 2209. This graphic representation is consistent with an alternating wild sequence result-type associated with the received record index.

Next, the process continues with the step of making the indicated payout at step 2220. As discussed above, the payout may be in the form of coins or tokens issued at electronic gaming machine 100, credits applied at the terminal, or a ticket printed at the terminal, for example. After step 2220, electronic gaming machine 100 is directed by its program code to wait for another play request input from the player at step 2221. Upon entry of the appropriate input, the method includes at step 2222 communicating the input as a play request to game server. As mentioned above, this play request preferably comprises a game index generated in response to activation of a particular input button or other input device included on the electronic gaming machine.

Now that the general process of the Class II or any reverse-mapped game play is understood, we may now discuss in further detail the sub process 2208 employed in preferred embodiments to produce the display sequence necessary to show the alternating wild symbols, and their associated game play sequence as it is presented to the player. At step 2210, the process has access to the index value for the game result with a known outcome. In preferred versions, the process queries an index table associated with the received record index at step 2210 to look up the game play record associated with the index value. While accessing a table stored at a data file or database is described, any other suitable architecture may be used, such as, for example, XML tagged data with an associated XML parsing or access engine employed to store and retrieve the correct data, including all of the data structures depicted in FIG. 2D.

FIG. 2D shows block diagrams of three different data structures employed in reverse mapping sub-process 2208 of FIG. 2C. The three depicted data structures are a game record 2301, an alternating wild sequence data structure 2311, and an alternating wild path definition 2321. The design and use of the data structures will be further described below. The data constituting these data structures is preferably stored in one or more game record files at the electronic gaming machine, and the server. Each file comprising a pool of game play records 2301 and associated data is used to produce a graphic game result sequence having alternating wild symbols as described herein. Each game play record 2301 includes or has associated with it a record index 2302. Each game play record may also include an index table identifier 2304, and perhaps other information such as prize amount 2303 and further information (not shown) which may be used for accounting and verification purposes. Finally, in this embodiment, each game record 2301 includes an alternating wild sequence result type record 2305, which identifies directly or by reference the types of sequences that may be used to achieve the desired prize amount for this game round. Some versions may identify the types of sequences only by their prize amount. Other versions may use a more detailed organization in classifying what types of sequences may go with what game results. For example, in some versions the result type record 2305 may include one field indicating the credit value required of the result presentation (for example 100 credits, 500 credits), and another field specifying how many alternating wild symbols should appear in the result (for example 1, 2, or 3 alternating wild symbols).

It should be noted that while three separate data structures are employed in this embodiment, various other designs within the scope of the invention may of course use fewer or more data structures. For example, some version may use an entirely flat table data structure in which each row contains the index value and all of the data necessary to display a single predetermined game outcome sequence to achieve a game outcome providing the prize associated with the index value.

The result type record 2305 is then used by the process to identify or select an alternating wild sequence data structure 2311 that will cause a display sequence according to the specified type. The sequence data structures 2311 are provided in a pool, and may be grouped by prize amount or other characteristics. The sequence data structure 2311 preferably includes a record of the complete array contents before the alternating wilds are applied (symbol array contents record 2312). It also includes a path definition data structure for each alternating wild symbol that will travel a path in the result (the symbol paths are listed as 1-n where n has a maximum of 3 in the preferred game design). The depicted path definitions 2313, 2314, and 2315 are each an alternating wild path definition 2321 data structure that defines the path for their related alternating wild symbol in the display sequence. Other embodiments may use an identifier for the path data structure 2321, and store the path data separately. In any event, the sequence data structure 2311 either includes data or an identifier for data contained in the depicted path data structure 2321. To define a path, the path data structure includes at data field 2322 a start location, which may be, as discussed above, the location from where the alternating symbol moves onto the screen, or where it starts as part of the game array results. Also defined explicitly or inherently by the game rules is the flip status of the alternating wild symbol, which preferably may be either flip or wild, although other embodiments may have more than two values that an alternating wild symbol may alternate between. Finally, the path data structure 2321 includes a movement direction and flip status for each movement in the path (2323-2325). The structure also defines the length of the path by having movements for n locations or n directions. This may be stored as a direction or a target location, and the flip status may be explicit or may be inherent in embodiments where the alternating wild symbol always flips, in order, from wild to flip and back. In any event, the path data structure includes data necessary to define start and stop locations and symbol state for its associated alternating wild symbol movement in the current game result sequence.

The sequence data structure 2311 may also include a pointer to a subroutine or program code. This subroutine is then executed at step 2212 after decision block 2211 to retrieve image data from an image library stored at electronic gaming machine storage device 207 (FIG. 3B) or other network storage arrangement. The subroutine performs the alternating wild sequences as indicated at 2213 and arranges the image data as appropriate at step 2214. This image data represents the display commands which are directed to graphics processor 215 through a suitable interface (not shown) at step 2215.

Figure 3A:
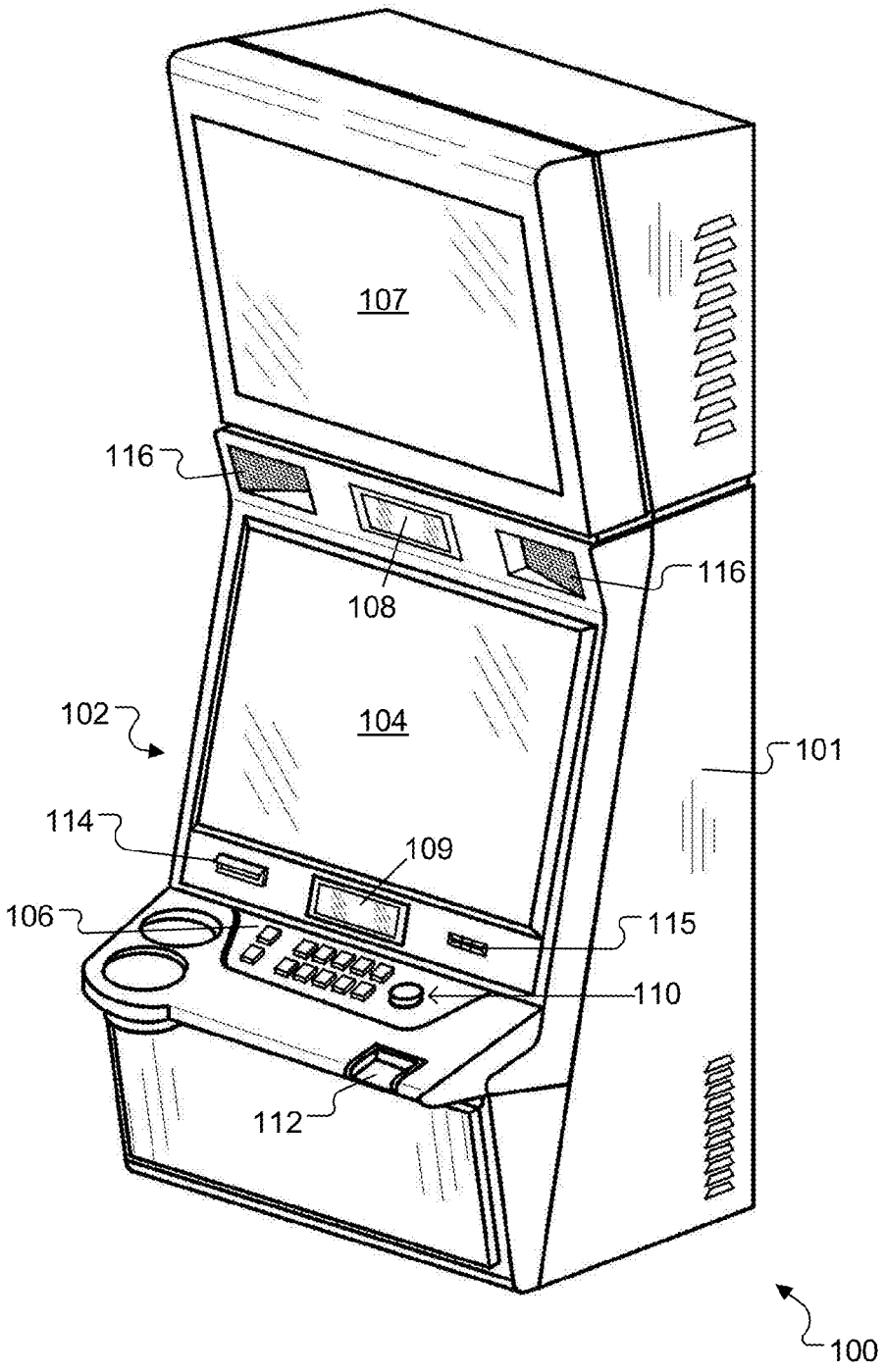
FIG. 3A is a front perspective view of a gaming machine which may be used in a gaming system embodying the principles of the present invention.
Figure 3B:
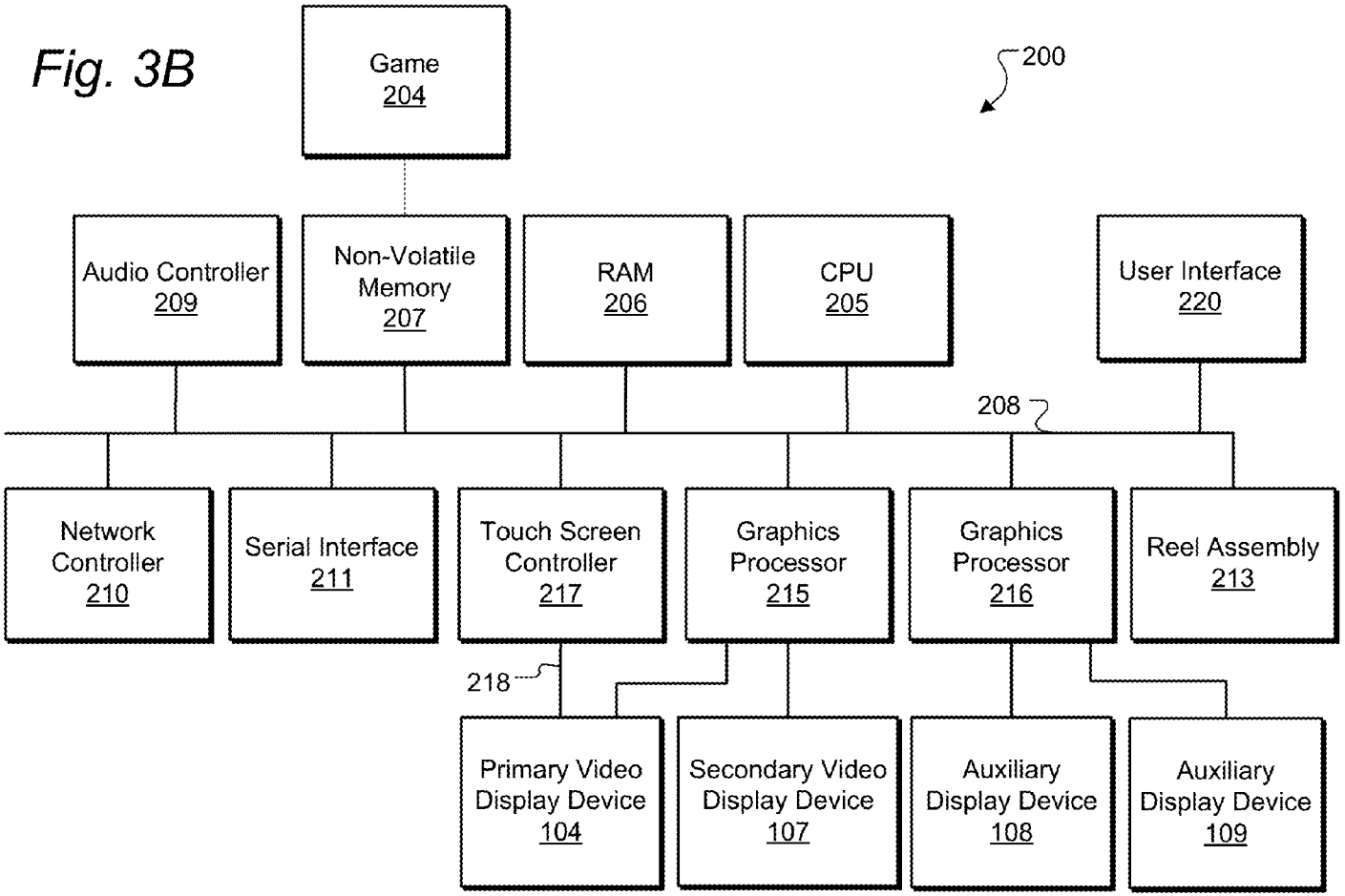
FIG. 3B is a block diagram showing various electronic components of the gaming machine shown in FIG. 3A together with additional gaming system components.

FIG. 3A shows a gaming machine 100 that may be used to implement an alternating wild game according to the present invention. The block diagram of FIG. 3B shows further details of gaming machine 100. Referring to FIG. 3A, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. All of the display devices and other display devices that may be included in gaming machine 100 may be referred to collectively as a display system.

In preferred versions, the gaming machine 100 illustrated in FIG. 3A also includes a number of mechanical control buttons 110 mounted on ledge 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls. The player controls or other interface devices may be referred to as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 3B shows a logical and hardware block diagram 200 of gaming machine 100 which includes a central processing unit (CPU) 205 along with random access memory 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 3A). A second graphics processor 216 is also connected on bus 208 in this example to drive the auxiliary display devices 108 and 109 also shown in FIG. 3A. As shown in FIG. 3B, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of primary video display device 104. The touch screen element itself is not illustrated or referenced separately in the figures. FIG. 3B also shows reel assembly 213 connected to CPU 205 to indicate that the alternating wild methods described above may be implemented through gaming machines including mechanical reels as will be described further below.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 3B are elements commonly associated with a personal computer. These elements are preferably mounted on a standard personal computer chassis and housed in a standard personal computer housing which is itself mounted in cabinet 101 shown in FIG. 3A. Alternatively, the various electronic components may be mounted on one or more circuit boards housed within cabinet 101 without a separate enclosure such as those found in personal computers. Those familiar with data processing systems and the various data processing elements shown in FIG. 3B will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 3B as being connected directly on system bus 208 may in fact communicate with the other system components through a suitable expansion bus. Audio interface 209, for example, may be connected to the system via a PCI bus. System bus 208 is shown in FIG. 3B merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104, secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display devices included with gaming machine 100. Also, a gaming machine implementing the present invention is not limited to any particular number of video display device or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game that may be available through the gaming machine and may also implement a game client for directing one or more display devices at the gaming machine to display portions of an alternating wild game according to the present invention. CPU 205 also executes software related to communications handled through network controller 210, and software related to various peripheral devices such as those connected to the system through audio interface 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for programs not in use or for other data generated or used in the course of gaming machine operation. Network controller 210 provides an interface to other components of a gaming system in which gaming machine 100 is included. In particular, network controller 210 provides an interface to a game controller which controls certain aspects of the alternating wild game according to some embodiments as will be discussed below in connection with FIGS. 3A-B.

It should be noted that the invention is not limited to gaming machines employing the personal computer-type arrangement of processing devices and interfaces shown in example gaming machine 100. Other gaming machines through which an alternating wild game and/or player selection game is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement an alternating wild game within the scope of the present invention using an electro mechanical arrangement or even a purely mechanical arrangement for displaying the symbols needed to complete the alternating wild game as described herein. However, the most preferred forms of the invention utilize one or more video display devices for displaying the spinning reels, the accumulated symbols, and the special wild offer. For example, a gaming machine suitable for providing a special wild game may include a mechanical reel-type display rather than a video-type display device for displaying results in a primary game, and include a video display device for presenting the alternating wild game as a bonus game.

Still referring to the hardware and logical block diagram 200, CPU or game processor 205 may comprise a conventional microprocessor, such as an Intel Pentium microprocessor, mounted on a printed circuit board with supporting ports, drivers, memory, software, and firmware to communicate with and control gaming machine operations, such as through the execution of program code stored in memory 207 including game program code 204. Game processor 205 is connect to user interface 220 (part of player input system) such that a player may enter input information and game processor 205 may respond according to its programming, such as to apply a wager and initiate execution of a game. Game processor 205 also may connect through network controller 210 to a gaming network, such as example casino server network 400 shown in FIG. 4B. Referring now to FIG. 4B, the casino server network 400 may be implemented over one or more site locations and include host server 401, remote game play server 403 (which may be configured to provide game processor functionality including determining game outcomes and providing audio/visual instructions to a remote gaming device), central determination server 405 (which may be configured to determine lottery, bingo, or other centrally determined game outcomes and provide the information to networked gaming machines 100 (EGM1-4 in FIG. 4B) providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

Referring now to FIG. 4A, a gaming system 300 according to another embodiment of the present invention is shown again in a network and system diagram format. System 300 includes a number of gaming machines, each comprising a gaming machine 100 in this example implementation. For purposes of describing system 300, each gaming machine 100 in FIG. 4A is shown as including a video display device 107 and a player interface that may include buttons, switches, or other physical controls and/or touch screen controls as discussed above in connection with FIG. 4A. This player interface is labeled 301 in FIG. 4A. System 300 further includes a game server 302 and a respective game client 303 (abbreviated "GC" in FIG. 4A) included with each respective gaming machine 100. In the form of the invention shown in FIG. 4A these two components, game server 302 and the game client components 303 combine to implement a game control arrangement which will be described in detail below. System 300 also includes an award controller 305, which is shown in FIG. 4A as being associated with game server 302 to indicate that the two components may be implemented through a common data processing device/computer system. Gaming machines 100, game server 302, and award controller 305 are connected in a network communication arrangement including first and second network switches 306 and 307, connected together through various wired or wireless signal paths, all shown as communications links 308 in FIG. 4A.

Each gaming machine 100, and particularly player interface 301 associated with each gaming machine, allows a player to make any inputs that may be required to make the respective gaming machine eligible for a special wild game, and make selections of any selectable objects displayed at the respective gaming machine in the course of the alternating wild game. Player interface 301 also allows a player at the gaming machine to initiate plays in a primary game available through the gaming machine in some implementations. The respective video display device 107 associated with each respective gaming machine 100 is used according to the invention to generate the graphic displays to show the various elements of a special wild game at the respective gaming machine.

The game control arrangement made up of game server 302 and the respective game client 303 at a given gaming machine functions to control the respective video display device 107 for that gaming machine to display a special wild graphic and a number of selectable objects. Award controller 305 is responsible for awarding prizes for a player's participation in a special wild game, and maintaining progressive prize information where the special wild game offers one or more progressive prizes. The network arrangement made up of network switches 306 and 307, and the various communication links 308 shown in FIG. 4A is illustrated merely as an example of a suitable communications arrangement. It should be noted that the game control arrangement, or as it is referred to generally the "game controller," may be implemented in some embodiments entirely on the gaming machine. This is especially true in jurisdictions that allow Class III gaming conducted with random number generators at each gaming machine. The present invention is not limited to any particular communications arrangement for facilitating communications between game server 302 and various gaming machines 100. Any wired or wireless communication arrangement employing any suitable communications protocols (such as TCP/IP for example) may be used in an apparatus according to the invention.

FIG. 4A shows other server(s) 310 included in the network. This illustrated "other server(s)" element 310 may include one or more data processing devices for performing various functions related to games conducted through system 300 and any other games that may be available to players through gaming machines 100. For example, apparatus 300 may be accounting servers providing support for cashless gaming or various forms of mixed cash/cashless gaming through the various gaming machines 100. In this example, an additional one of the other servers 310 will be included in apparatus 300 for supporting these types of wagering and payout systems. As another example, the various gaming machines 100 included in system 300 may allow players to participate in a game (primary game) other than the alternating wild game and player selection game described herein, and this other game may rely on a result identified at or in cooperation with a device that is remote from the gaming machines. In this example, another server 310 may be included in the system for identifying results for the primary game and communicating those results to the various gaming machines 100 as necessary. Generally, the other server(s) 310 shown in FIG. 4A are shown only to indicate that numerous other components may be included along with the elements that participate in providing alternating wild games according to the present invention. Other server(s) 310 may provide record keeping, player tracking, accounting, result identifying services, or any other services that may be useful or necessary in a gaming system.

Referring to FIG. 4B, a block diagram of another example networked gaming system 400 associated with one or more gaming facilities is shown, including one or more networked gaming machines 100 in accordance with one or more embodiments. With reference to FIG. 4B, while a few servers have been shown separately, they may be combined or split into additional servers having additional capabilities.

As shown, networked gaming machines 100 (EGM1-EGM4) and one or more overhead displays 413 may be network connected and enable the content of one or more displays of gaming machines 100 to be mirrored or replayed on an overhead display. For example, the primary display content may be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective players' video images may be displayed on overhead display 413 along with the content of the player's display 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Blackberry cell phone, Apple iPhone, personal data assistant (PDA), iPad, etc.). To enter the website, a player may log in with a username (that may be associated with the player's account information stored on player account server 409 or be accessible by a casino operator to obtain player data and provide promotional offers), play various games on the website, make various personalizing selections, and save the information, so that during a next gaming session at a casino establishment, the player's playing data and personalized information may be associated with the player's account and accessible at the player's selected gaming machine 100.

Figure 5A:
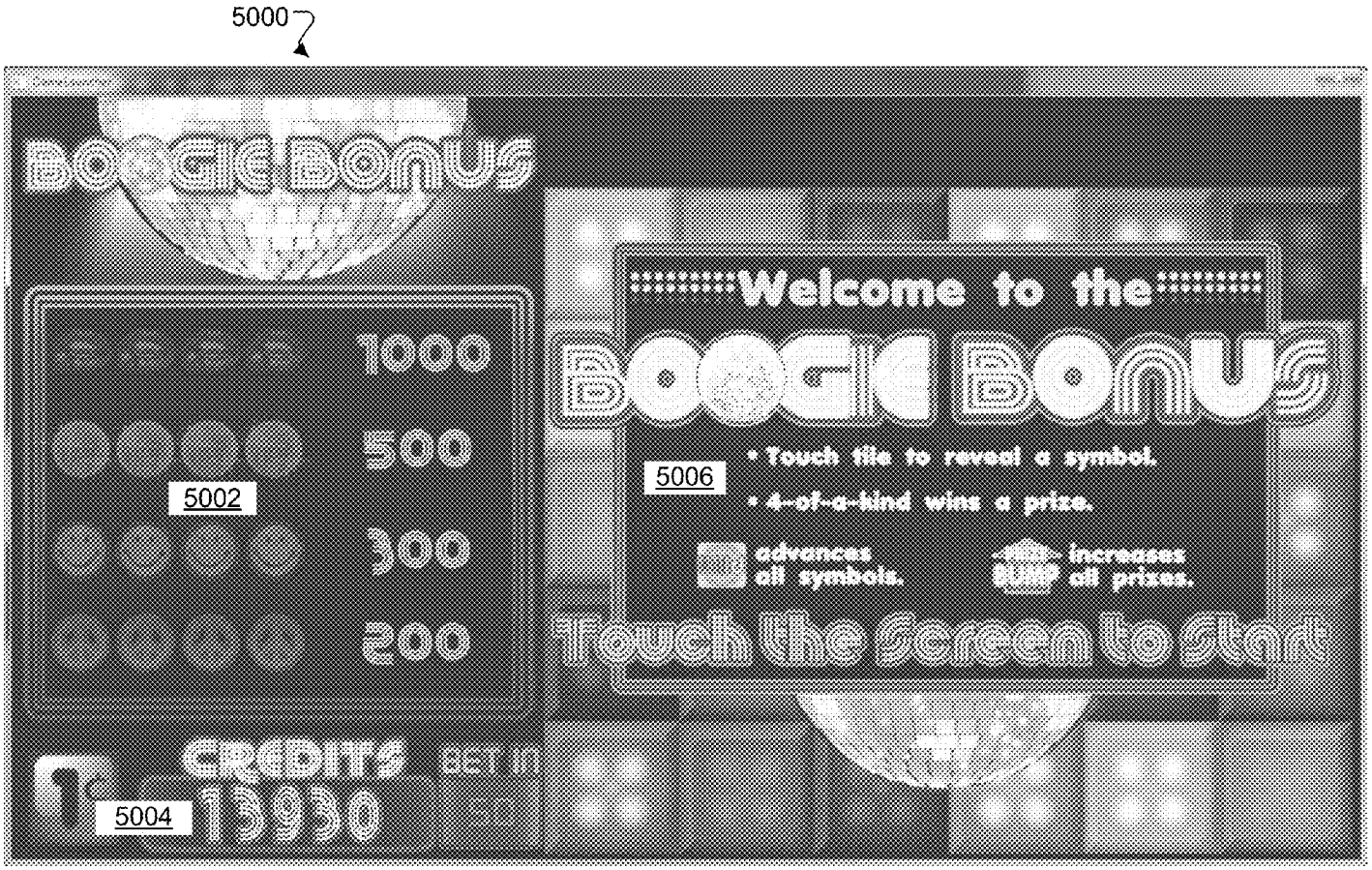
FIG. 5A is a game screen diagram illustrating a bonus start screen of a player selection game according to one embodiment of the present invention.

FIG. 5A shows a game screen diagram 5000 illustrating a bonus start screen of a player selection game according to one embodiment. In the depicted screenshot, the display system of the gaming machine is displaying a bonus start screen including a prize table 5002, current credits 5004, and instructions on how to play 5006. The instructions 5006 indicate that the object of the game is to accumulate four symbols (winning symbols) of a kind to win a prize. In this embodiment, the symbols are accumulated by uncovering tiles in a field of symbol locations. In the initial state shown in FIG. 5A (although partially covered by the "Welcome" graphic), each symbol location simply comprises a tile and does not indicate any associated game symbol. As will be discussed below, a game symbol is displayed at a respective symbol location responsive to the player selection of that respective symbol location. Prize table 5002 provides symbol accumulation areas separate from the field of symbol locations to track the symbols which have been accumulated in the course of the game. In the embodiment shown in FIG.

5A, the instructions also describe a wild symbol that "advances all symbols", or adds one to the count of accumulated symbols for all the sets of symbols. Further, the instructions describe a prize bump bonus symbol that, when uncovered, increases the value of the bonus prizes. In this embodiment, the prize bump symbol increases each prize by its original amount at the start of the bonus round, essentially operating as a multiplier for the prize value.

Figure 5B:
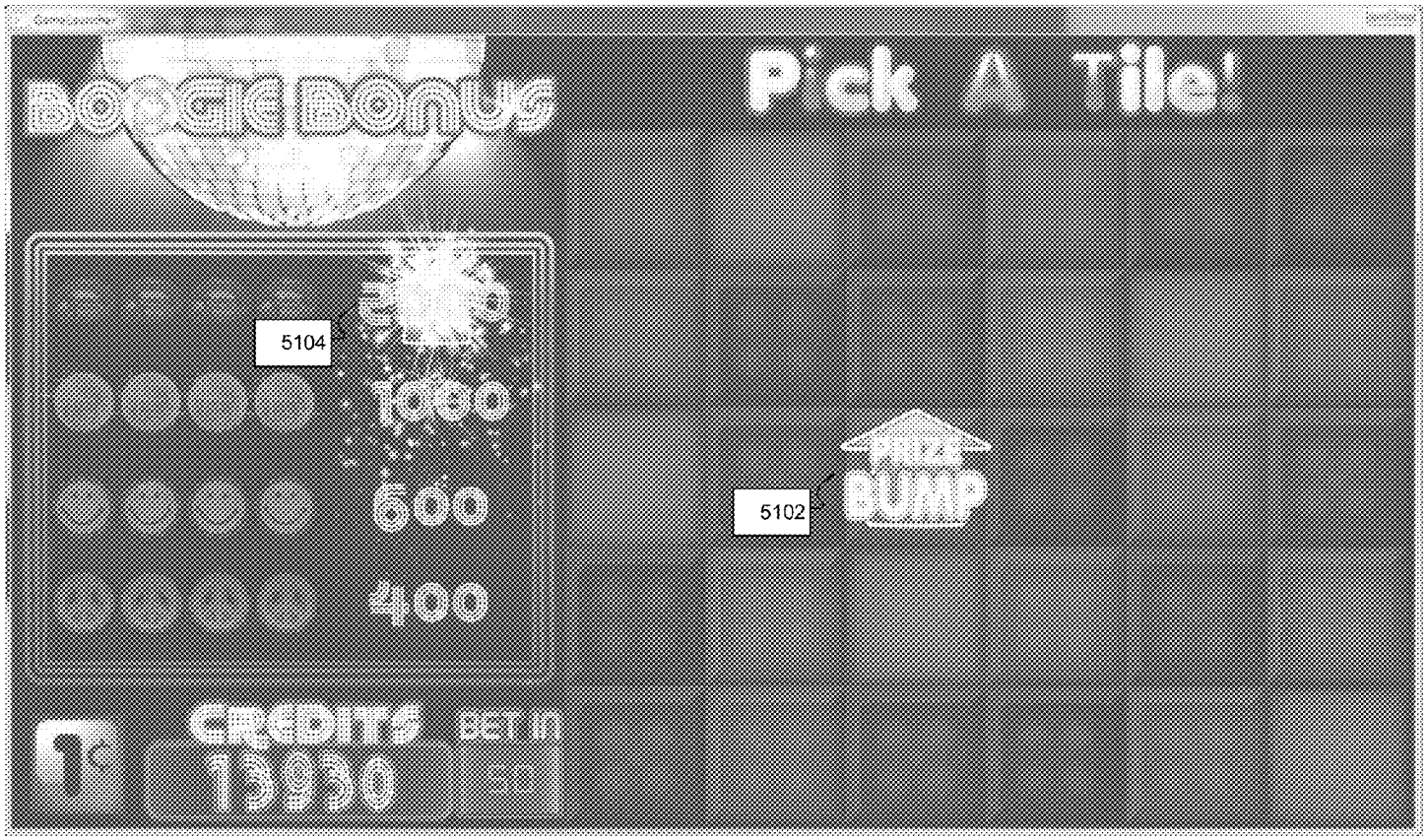
FIG. 5B is a game screen diagram showing the prize bump bonus feature according to one embodiment of a player selection game.
Figure 5C:
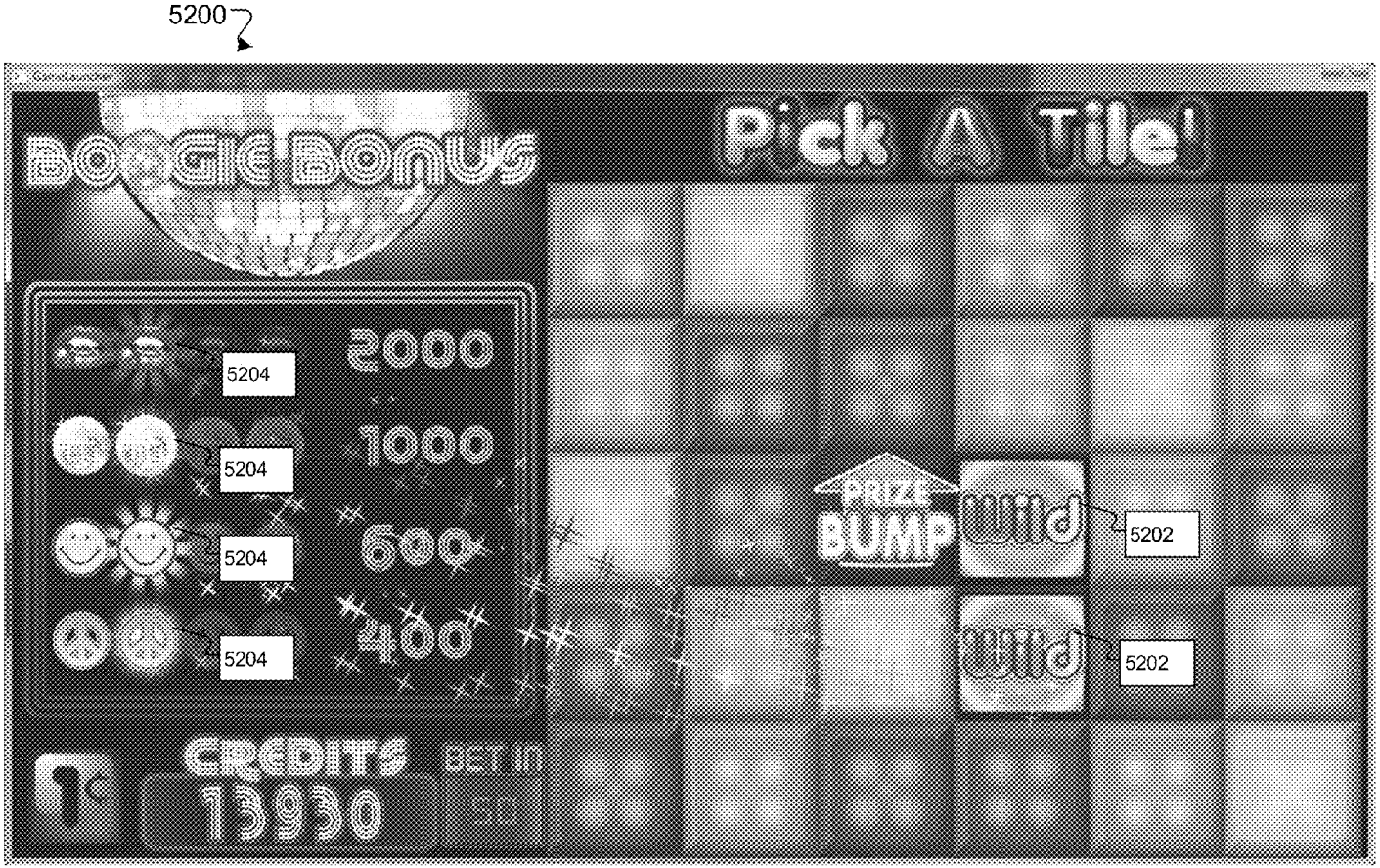
FIG. 5C is a game screen diagram showing the use of wild symbols in the player selection game.

FIGS. 5B-D are a sequence of game screens occurring in one example game play scenario. FIG. 5B shows another screenshot 5100 of the player selection bonus game after it has begun. In this embodiment the player has already made a selection 5102, which revealed a prize bump bonus symbol. As a result, in this embodiment the prizes are now increased to double their original value as indicated at 5104, which is accompanied by an animated sequence shown on the prize table accompanying the changes of value. Although in this embodiment the prizes are increased by their original amounts, other embodiments may increase the designated group of prizes in different ways, including adding a fixed amount to each prize or applying a multiplier to each prize, or shifting the prizes such that the lowest value prize moves off of the prize table and is deleted, while the second lowest prize moves down to occupy the lowest prize pattern, and all of the other prizes shift down one pattern to accommodate a new highest prize level.

Further, while this embodiment increases all of the available bonus prizes, other embodiments may increase only a designated group of bonus prizes. For example, the prize bump symbol may increase all but the top prize available, or all non-jackpot prizes or prizes funded by the player's wager in the current game, while not bumping or increasing prizes such as jackpots or large bonus prizes. Other embodiments may include more than one variation of the prize bump symbol, each variation associated with a specific designated group of prizes. For example, a bump symbol may be associated with a group of prizes by color, or some other graphical theme. The illustrated embodiment has only one type of bump symbol and that bump symbol bumps all four available prizes in the depicted bonus round.

FIG. 5C shows a screenshot diagram 5200 of the player selection game after the player has made two more selections after the condition shown in FIG. 5B. In this case both of the player's selections 5202 have been wild symbols. As a result, the player receives credit for having accumulated two of each type of symbol 5204. As depicted by the scattered star images flowing from the currently selected wild symbol (the lower symbol 5202) to the symbol accumulation area, an animation preferably accompanies the game's application of the wild symbol to increase the count of each accumulated symbol.

FIG. 5D shows a game screen diagram 5300 showing the player selection bonus game after the bonus game has reached an end condition. The illustrated embodiment ends the game after the player has won a prize. Other embodiments may use different conditions to end the player selection game, including ending the game after the player has won a designated number of prizes, or after the player has used a designated number of selections. In the depicted scenario, the player uncovers another prize bump symbol 5306, which causes the prizes 5308 to increase to three times their original value. In their next selection, the player uncovers a "happy face" symbol 5310, which gave the player three happy face symbols. Next, in the scenario, player selection uncovers the cherry lips symbol 5314. The player's final selection uncovers an additional wild symbol 5302, which increases the count of every symbol, giving the player enough accumulated cherry lips symbols 5316 to win the prize for that winning symbol (the collective symbols to win the cherry lips prize consisting of three wild symbols and one cherry lips symbol) and enough accumulated happy face symbols 5312 to win the prize for that winning symbol (this winning set consisting of three wild symbols and one happy face symbol). It should be understood that the scenario depicted herein is only one example of how a game may proceed, given in order to illustrate the features of the symbol selection, and the wild symbol and the prize bump symbol as they are applied to the player selection game. Actual game results are determined randomly by game system.

As used herein, whether in the above description or the following claims, the terms "comprising," "including," "carrying," "having," "containing," "involving," and the like are to be understood to be open-ended, that is, to mean including but not limited to. Also, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method of providing a player selection wagering game through an electronic gaming machine, the method including:

(a) via an acceptor of the gaming machine, accepting a physical item associated with a monetary value;

(b) displaying a number of symbol locations in an initial state in a symbol location field of a display system of the gaming machine, each symbol location in the initial state providing an area in which to display a respective game symbol but showing a graphic other than the respective game symbol;

(c) receiving a player selection input through a player input system associated with the gaming machine, the player selection input indicating a respective one of the symbol locations in the initial state;

(d) in response to the player selection input, displaying a respective game symbol at the indicated one of the symbol locations so that the indicated symbol location is no longer in the initial state, the respective game symbol comprising a symbol from a set of game symbols defined for the game;

(e) displaying two or more symbol accumulation areas on the display system of the gaming machine, each respective symbol accumulation area being defined for a respective winning symbol comprising one of the game symbols and being displayed in an area of the display system separate from the symbol location field;

(f) when the game symbol displayed at a respective symbol location at step (d) comprises i. one of the winning symbols, displaying that winning symbol in the symbol accumulation area defined for that winning symbol; or ii. a wild symbol, displaying a winning symbol in the symbol accumulation area defined for each of two or more of the winning symbols;

(g) repeating steps (c),(d),(e), and (f) until reaching a game ending condition; and (h) upon reaching the game ending condition, awarding any prize defined for the number of winning symbols displayed in the symbol accumulation area defined for that winning symbol.

2. The method of claim 1 further including for each symbol accumulation area, displaying a prize value associated with selecting a predefined number of the respective winning symbol for that symbol accumulation area.

3. The method of claim 2 wherein at least one of the symbols in the set of game symbols comprises a prize increasing symbol and further including, in response to the game symbol displayed at step (d) of claim 1 comprising a prize increasing symbol, increasing the value of the respective prize associated with one of the winning symbols.

4. The method of claim 3 wherein in response to the game symbol displayed at step (d) of claim 1 comprising the prize increasing symbol, increasing the value of the respective prize associated with each winning symbol.

5. The method of claim 3 wherein increasing the value of the respective prize includes applying a multiplier to the respective prize value.

6. The method of claim 1 wherein the game ending condition comprises the display of a predefined number of any of the winning symbols.

7. A gaming system including:

(a) a player input system including an acceptor configured to accept a physical item associated with a monetary value:

(b) a display system;

(c) one or more processors; and (d) one or more memory devices storing program instructions executable by the one or more processors to:

(i) cause the display system to display a number of symbol locations in an initial state within a symbol location field, each symbol location in the initial state providing an area in which to display a respective game symbol but showing a graphic other than the respective game symbol;

(ii) receive a player selection input entered through the player input system, the player selection input indicating a respective one of the symbol locations in the initial state;

(iii) in response to the player selection input, cause the display system to display a respective game symbol at the indicated one of the symbol locations so that the indicated symbol location is no longer in the initial state, the respective game symbol complising a symbol from a set of game symbols defined for the game;

(iv) cause the display system to display two or more symbol accumulation areas, each respective symbol accumulation area being defined for a respective winning symbol comprising one of the game symbols and being displayed in an area of the display system separate from the symbol location field;

(v) when the game symbol displayed at a respective symbol location at operation (iii) of this claim comprises I. one of the winning symbols, cause the display system to display that winning symbol in the symbol accumulation area defined for that winning symbol, or II. a wild symbol, displaying a winning symbol in the symbol accumulation area defined for each of two or more of the winning symbols;

(vi) repeat operations (ii), (iii), (iv), and (v) of this claim until reaching a game ending condition; and (vii) upon reaching the game ending condition, award any prize defined for the number of winning symbols displayed in the symbol accumulation area defined for that winning symbol.

8. The gaming system of claim 7 wherein the program instructions are also executable to, for each symbol accumulation area, cause the display system to display a prize value associated with selecting a predefined number of the respective winning symbol for that symbol accumulation area.

9. The gaming system of claim 8 wherein at least one of the symbols in the set of game symbols comprises a prize increasing symbol and wherein the program instructions are also executable to, in response to the game symbol displayed at operation (iii) of claim 7 comprising a prize increasing symbol, increase the value of the respective prize associated with one of the winning symbols.

10. The gaming system of claim 9 wherein the program instructions are also executable to, in response to the game symbol displayed at operation (iii) of claim 7 comprising the prize increasing symbol, increase the value of the respective prize associated with each winning symbol.

11. The gaming system of claim 9 wherein increasing the value of respective prize includes applying a multiplier to the respective prize value.

12. The gaming system of claim 7 wherein the game ending condition comprises the display of a predefined number of any of the winning symbols.

13. A program product comprising one or more non-transitory computer readable storage devices storing program code, the program code including:

(a) game program code executable by a processor associated with an electronic gaming machine to control an acceptor of the gaming machine, the acceptor being configured to accept a physical item associated with a monetary value, the game program code also executable to (i) cause a display system of the gaming machine to display a number of symbol locations in an initial state within a symbol location field, each symbol location in the initial state providing an area in which to display a respective game symbol but showing a graphic other than the respective game symbol;

(ii) receive a player selection input entered through a player input system of the gaming machine, the player selection input indicating a respective one of the symbol locations in the initial state;

(iii) in response to the player selection input, cause the display system to display a respective game symbol at the indicated one of the symbol locations so that the indicated symbol location is no longer in the initial state, the respective game symbol comprising a symbol from a set of game symbols defined for the game;

(iv) cause the display system to display two or more symbol accumulation areas, each respective symbol accumulation area being defined for a respective winning symbol comprising one of the game symbols and being displayed in an area of the display system separate from the symbol location field;

(v) when the game symbol displayed at a respective symbol location at operation (iii) of this claim comprises I. one of the winning symbols, cause the display system to display that winning symbol in the symbol accumulation area defined for that winning symbol, or II. a wild symbol, displaying a winning symbol in the symbol accumulation area defined for each of two or more of the winning symbols;

(vi) repeat operations (ii), (iii), (iv), and (v) of this claim until reaching a game ending condition; and (b) award program code executable to, upon reaching the game ending condition, award any prize defined for the number of winning symbols displayed in the symbol accumulation area defined for that winning symbol.

14. The program product of claim 13 wherein the game program code is also executable to, for each symbol accumulation area, cause the display system to display a prize value associated with selecting a predefined number of the respective winning symbol for that symbol accumulation area.

15. The program product of claim 14 wherein at least one of the symbols in the set of game symbols comprises a prize increasing symbol and wherein the game program code is also executable to, in response to the game symbol displayed at operation (iii) of claim 13 comprising a prize increasing symbol, increase the value of the respective prize associated with one of the winning symbols.

16. The program product of claim 15 wherein the game program code is also executable to, in response to the game symbol displayed at operation (iii) of claim 13 comprising the prize increasing symbol, increase the value of the respective prize associated with each winning symbol.

17. The program product of claim 13 wherein the game ending condition comprises the display of a predefined number of any of the winning symbols.

* * * * *